US009526971B1

(12) United States Patent
Barden et al.

(10) Patent No.: US 9,526,971 B1
(45) Date of Patent: Dec. 27, 2016

(54) REMOTE RELEASE SKI BINDING

(71) Applicant: Rossland Binding Company, Rossland (CA)

(72) Inventors: Rob C. Barden, Red Deer (CA); Gautam Goodapati, Rossland (CA); Blair L. Fredricks, Osoyoos (CA); Gordon J. Wilson, Auckland (NZ); Jeffrey Wayne Herr, Rossland (CA)

(73) Assignee: ROSSLAND BINDING COMPANY, Rossland, BC (CA)

( * ) Notice: Subject to any disclaimer, the term of this patent is extended or adjusted under 35 U.S.C. 154(b) by 0 days.

(21) Appl. No.: 14/857,989

(22) Filed: Sep. 18, 2015

(51) Int. Cl.
*A63C 9/088* (2012.01)

(52) U.S. Cl.
CPC ..... *A63C 9/0885* (2013.01)

(58) Field of Classification Search
CPC ..... A63C 9/0885; A63C 9/088; A63C 9/0802
USPC ..... 280/611, 613, 612
See application file for complete search history.

(56) References Cited

U.S. PATENT DOCUMENTS

| | | | | |
|---|---|---|---|---|
| 2,854,242 | A | 9/1958 | Pratt | |
| 3,596,374 | A | 8/1971 | Covington | |
| 3,635,485 | A | 1/1972 | Gertsch et al. | |
| 3,764,154 | A | 10/1973 | Witting | |
| 3,787,868 | A * | 1/1974 | Camp | A63C 9/0885 340/12.5 |
| 3,794,339 | A * | 2/1974 | Smolka | A63C 9/0885 280/612 |
| 3,819,199 | A | 6/1974 | Smolka et al. | |
| 3,860,253 | A | 1/1975 | Schweizer | |
| 3,861,698 | A | 1/1975 | Greig | |
| 3,873,111 | A | 3/1975 | Imagawa | |
| 3,892,422 | A | 7/1975 | Jasques et al. | |
| 3,895,817 | A | 7/1975 | Gertsch et al. | |
| 3,909,025 | A | 9/1975 | Gertsch et al. | |
| 3,909,028 | A | 9/1975 | Courvoisier et al. | |
| 3,950,000 | A | 4/1976 | Sittmann | |
| 3,977,688 | A | 8/1976 | Imagawa | |
| 4,077,653 | A | 3/1978 | Beyl | |
| 4,098,010 | A | 7/1978 | Rothmayer | |

(Continued)

FOREIGN PATENT DOCUMENTS

| | | |
|---|---|---|
| DE | 2309888 | 8/1974 |
| DE | 102007001599 | 7/2007 |

(Continued)

*Primary Examiner* — J. Allen Shriver, II
*Assistant Examiner* — Brian Cassidy
(74) *Attorney, Agent, or Firm* — Workman Nydegger

(57) ABSTRACT

In one example, a ski binding control and release assembly includes a housing, a motor disposed in the housing, an actuator element disposed in the housing and connected to the motor, and an arm partly disposed in the housing, the arm being operably engaged with the actuator element, and the arm being selectively engageable with a toe piece. A cover is also provided that encloses a substantial portion of the housing. A binding plate is provided that is configured to be disposed on top of the cover, and the binding plate, cover and housing forming a stack that is mountable to a ski. Finally, a control system is provided that is remotely operable to move the arm, and the control system is configured for wireless communication with a remote control device.

30 Claims, 18 Drawing Sheets

(56) References Cited

U.S. PATENT DOCUMENTS 4,121,854 A * 10/1978 Cornu ..... A63C 9/0802 280/612
4,160,555 A * 7/1979 Salomon ..... A63C 9/088 280/612
4,251,090 A 2/1981 Weigl
4,264,087 A 4/1981 Bortoli
4,291,894 A * 9/1981 D'Antonio ..... G01L 5/03 280/611
4,294,460 A 10/1981 Kirsch
4,436,321 A 3/1984 Storandt
4,444,411 A * 4/1984 Svoboda ..... A63C 9/088 280/611
4,548,424 A * 10/1985 Spitaler ..... A63C 9/088 280/612
4,563,021 A * 1/1986 Klubitschko ..... A63C 9/088 280/612
4,776,608 A * 10/1988 Caillat ..... A63C 9/08557 280/634
4,854,605 A 8/1989 Emerson
4,934,669 A 6/1990 Bourdeau et al.
5,082,410 A 1/1992 Provence
5,085,453 A * 2/1992 Bildner ..... A63C 9/005 280/612
5,106,118 A 4/1992 Frey
5,129,668 A 7/1992 Hecht
5,150,913 A * 9/1992 Hoelzl ..... A63C 9/0885 200/302.2
5,167,424 A 12/1992 Baggio et al.
5,213,356 A 5/1993 Rohrmoser
5,253,894 A 10/1993 Thomas et al.
5,295,704 A 3/1994 Flock
5,297,812 A 3/1994 Dogat et al.
5,326,126 A 7/1994 Ruffinengo
5,338,051 A 8/1994 Szafranski et al.
5,344,178 A 9/1994 Rohrmoser
5,411,283 A * 5/1995 Nowak ..... A63C 9/088 280/612
5,498,017 A * 3/1996 Rohrmoser ..... A63C 9/0802 280/612
5,509,683 A * 4/1996 Daniel ..... A63C 7/1086 280/28.11
5,566,966 A 10/1996 Couderc et al.
5,575,496 A 11/1996 Luitz et al.
5,611,559 A 3/1997 Luitz et al.
5,636,856 A 6/1997 Luitz et al.
5,735,541 A 4/1998 Fritschi et al.
6,007,086 A * 12/1999 Hopkins ..... A63C 9/0802 280/612
6,050,591 A 4/2000 Bardin et al.
6,056,310 A 5/2000 Hangl
6,095,547 A 8/2000 Vandergrift et al.
6,227,558 B1 5/2001 Arduin et al.
6,454,291 B1 9/2002 Hillairet et al.
6,471,235 B1 10/2002 Luitz et al.
6,513,826 B1 2/2003 Hangl
6,565,110 B1 5/2003 Holzer
6,623,026 B2 9/2003 Dogat et al.
6,641,162 B2 11/2003 Allmann et al.
6,659,494 B1 * 12/2003 Martin ..... A63C 9/0802 280/612
6,769,711 B1 8/2004 Martin et al.
6,840,531 B2 1/2005 Gorza et al.
7,017,808 B2 3/2006 Holzer
7,073,812 B2 7/2006 Rigal et al.
7,104,564 B2 9/2006 Martin et al.
7,523,953 B2 * 4/2009 Ettlinger ..... A63C 9/081 280/14.23
7,815,213 B2 * 10/2010 Damiani ..... A63C 9/088 280/611
7,841,614 B2 * 11/2010 Damiani ..... A63C 9/088 280/611
8,403,354 B2 * 3/2013 Senner ..... A63C 9/0802 280/623
8,612,181 B2 12/2013 Czaja et al.
8,910,967 B2 12/2014 Bjertnaes et al.
2005/0194764 A1 * 9/2005 Bluemel ..... A63C 9/0885 280/611
2007/0090627 A1 * 4/2007 Laurent ..... A63C 9/088 280/612
2007/0170695 A1 * 7/2007 Damiani ..... A63C 9/088 280/617
2007/0170696 A1 * 7/2007 Damiani ..... A63C 9/088 280/617
2009/0212534 A1 * 8/2009 Mercat ..... A63C 9/0802 280/613
2009/0243259 A1 * 10/2009 De La Torre Rodriguez ..... A63C 9/0802 280/618

FOREIGN PATENT DOCUMENTS

| | | |
|---|---|---|
| DE | 102011100933 | 11/2012 |
| FR | 2823985 | 10/2002 |
| FR | 2853254 | 10/2004 |
| WO | WO9512440 | 5/1995 |
| WO | WO0213924 | 2/2002 |

* cited by examiner

REMOTE RELEASE SKI BINDING

FIELD OF THE INVENTION

The present disclosure is generally concerned with sporting equipment and, in particular, with a remote release ski binding and associated controls.

BACKGROUND

A number of advances have been made over the years to improve the safety and functionality of ski bindings. Notable among these is the self-release, or automatic release, ski binding. Such bindings may also be referred to as safety release bindings. In general, such bindings include separate ski boot heel and toe retention mechanisms that can each be set to automatically release the ski boot when loads of a particular magnitude are applied, such can occur as in a crash or a fall. The release points can be set so as to account for considerations such as the size, weight, and relative skill level of the skier. While there is little question that automatic release ski bindings have made a significant contribution to improving the safety of skiing, those bindings still have a number of shortcomings both in terms of their safety and convenience of use.

For example, although it is often desirable for a ski binding to release automatically in the event of a fall or crash, mechanical failures sometimes occur that hinder or prevent operation of the automatic release mechanism. Such failures can result in injury to the skier and/or damage to the skis and bindings.

As another example, circumstances sometimes occur in which a skier is involved in an incident that, while potentially dangerous, is not sufficient to cause release of the boots of the skier from the bindings. By way of illustration, a skier may get stuck in a tree well simply by skiing too close to a tree. Although there may have been no crash, and possibly only a minor fall involved, it is well known that tree wells can be dangerous and, as such, the skier who falls into one may be in a potentially life threatening situation.

A significant part of the danger posed by tree wells is that it can be quite difficult for the skier to extricate himself, and skiers have been known to suffocate, or die of hypothermia, in the attempt. Escape from a tree well may be complicated significantly by the fact that the skier's boots are still attached to his skis because the bindings have not released. Moreover, the skier may be in an awkward position that makes it difficult or impossible to reach the bindings and manually release them. Thus, in this scenario, self release bindings may be of little use in helping the skier escape his predicament.

As a further illustrative example of some shortcomings of conventional manual release ski bindings, it is not uncommon for novice skiers, in particular, to get one or both skis caught on a chair, rope, tow, tram, gondola, or other equipment when the skier is loading or unloading. Because the lift typically cannot stop immediately, the skier may find himself being dragged, pulled, or flipped by his skis for some distance. In some cases, the forces involved are significant enough to trigger automatic release of the boot ski binding, but this is not always the case, and the skier may still suffer injury even if the forces are not adequate to trigger release of the boot from the ski binding.

Other shortcomings of typical safety release bindings may be more a matter of convenience than safety. For example, when novice skiers, particularly younger skiers, crash or fall, their bindings may not release, typically because such crashes and falls are low speed events. Nonetheless, it can be difficult for these skiers to get their skis oriented properly so that they can get back on their feet and begin skiing again. This is particularly so if the skier should happen to fall in relatively deep snow.

Moreover, even if a skier is experienced, it is not uncommon for skiers to be involved in crashes or falls where one or both of the bindings do not release. If such a crash or fall occurs in deep snow, for example, it can be quite difficult and time consuming for the skier to dig out and return to skiing if the skis are still attached to the boots of the skier. This may be particularly so if there is no one nearby to assist the skier.

In view of problems such as those noted, what is needed is a ski binding that will release a locked in ski boot at any time on the initiative of the user. As well, the ski binding should be configured to release the ski boot without requiring the user to manually operate or manipulate any part of the ski binding. These example functionalities may be of particular interest, for example, to seniors and skiers that find themselves unable to stand back up because they have had a fall, and are unable to manually release their bindings.

BRIEF SUMMARY OF ASPECTS OF SOME EXAMPLE EMBODIMENTS

Various disclosed embodiments are concerned with ski bindings and, more particularly, with ski bindings that can release a ski boot at any time upon the initiative of the user. This release function of the ski binding can be effected remotely by a user.

More particularly, example embodiments within the scope of this disclosure may include one or more of the following elements, in any combination: a ski binding configured to release a locked in ski boot at any time upon the initiative of a user; a ski binding configured to release a locked in ski boot upon actuation of a remote control by a user; a ski binding having a ski boot engagement portion configured for remote control by a user; a toe piece of a ski binding configured for remote control by a user; a ski binding configured to release a locked in ski boot without requiring the user to manually operate or manipulate any part of the ski binding; a remote control device operable by a user to operate a ski binding so that the ski binding releases a locked in boot; an electronic remote control device operable by a user to operate a ski binding so that the ski binding releases a locked in boot; a remote control device operable by a user to operate a ski binding so that the ski binding releases a locked in boot, wherein the remote control device is electronic and is housed within a fob or a ski pole; a ski binding including electronics that are operable to emit a locator signal perceptible by a user; a ski binding including electronics that are operable to emit a locator signal perceptible by a user, wherein the electronics are configured to be activated remotely by a user; a ski binding that includes a servomotor and spring-loaded arm that are collectively operable to release a ski boot locked into the ski binding; a ski binding that includes a servomotor, which may be electrically powered, or other type of motor, with a shaft or rotary encoder; and, a ski including any of the aforementioned ski bindings.

Following is a list of various example embodiments of the invention. It should be noted that such embodiments, and the other embodiments disclosed herein, do not constitute an exhaustive summary of all possible embodiments, nor does this summary constitute an exhaustive list of all aspects of any particular embodiment(s). Rather, this summary simply presents selected aspects of some example embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

In a first example embodiment, a ski binding includes a ski boot engagement portion configured for electronic remote control by a user.

In a second example embodiment, a ski binding includes a toe piece configured for electronic remote control by a user.

In a third example embodiment, a ski binding includes a heel piece configured for electronic remote control by a user.

In a fourth example embodiment, a ski binding includes a ski boot engagement portion configured for electronic remote control by a user, and the ski binding is any one of an alpine ski binding, an alpine touring (AT) ski binding, a telemark ski binding, or a cross-country ski binding.

In a fifth example embodiment, a ski binding includes a ski boot engagement portion configured for electronic remote control by a user, and the ski binding includes electronics that are operable to emit a locator signal perceptible by a user, wherein the electronics are configured to be activated remotely by a user.

In a sixth example embodiment, a ski binding includes a ski boot engagement portion that can be reset to a boot engagement position after being remotely released by a user.

In a seventh example embodiment, a ski binding includes a motorized ski boot engagement portion that can be moved to a boot engagement position after being remotely released by a user.

In an eighth example embodiment, a ski binding is configured so that the ski binding releasably locks a ski boot by first engaging a heel of the ski boot and, subsequently, engaging a toe of the ski boot.

In a ninth example embodiment, an electronic remote control device is configured to remotely electronically operate any of the preceding embodiments of a ski binding to cause the ski binding to release a boot locked into the ski binding.

In a tenth example embodiment, a ski is provided that includes any of the aforementioned embodiments of a ski binding.

BRIEF DESCRIPTION OF THE DRAWINGS

The appended drawings contain figures of example embodiments to further illustrate and clarify various aspects of the present invention. It will be appreciated that these drawings depict only example embodiments of the invention and are not intended to limit its scope. Aspects of the invention will be described and explained with additional specificity and detail through the use of the accompanying drawings in which.

DETAILED DESCRIPTION OF SOME EXAMPLE EMBODIMENTS

Figure 1:
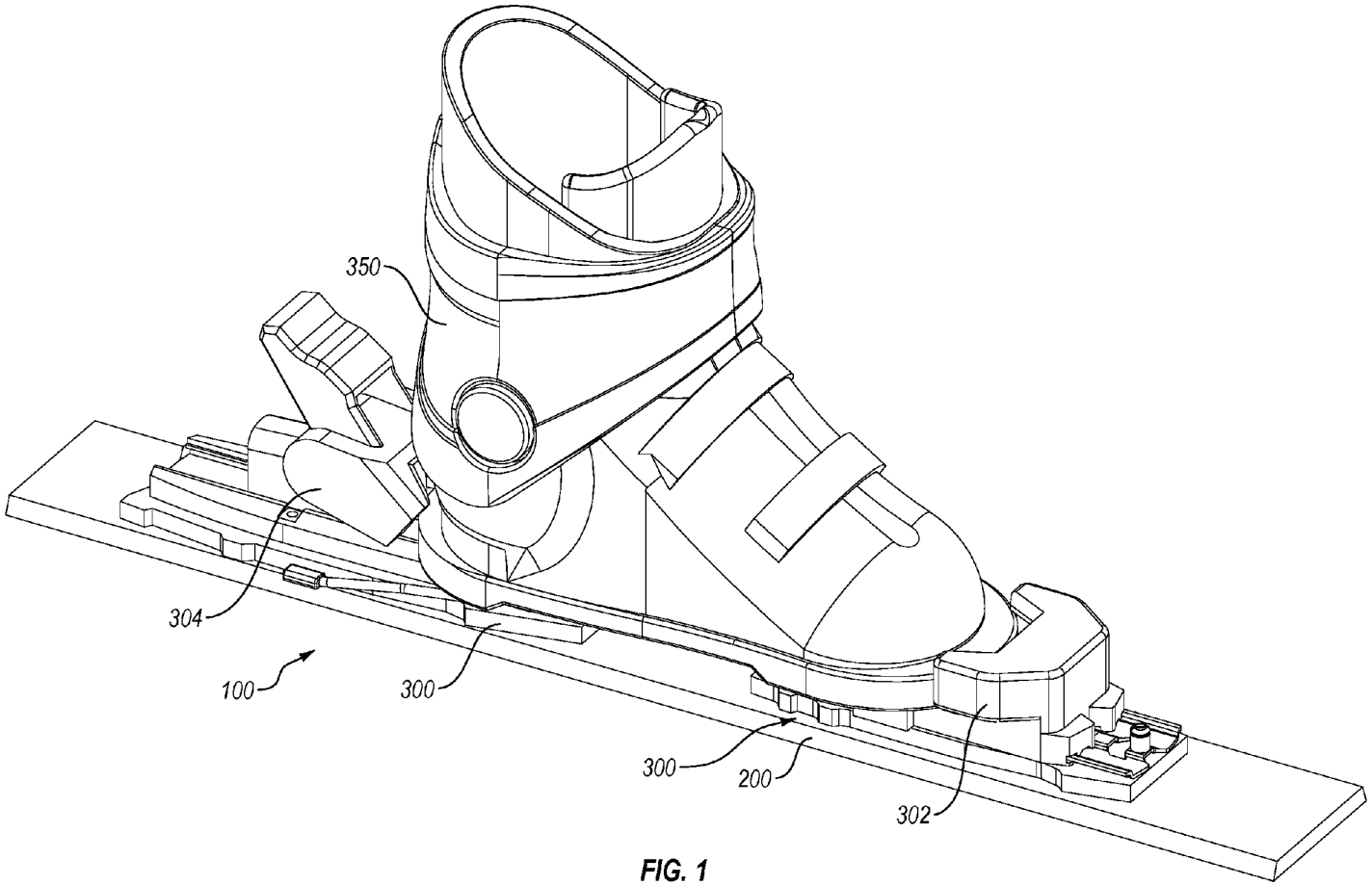
FIG. 1 is a side view of an example ski binding, ski and ski boot.
Figure 2:
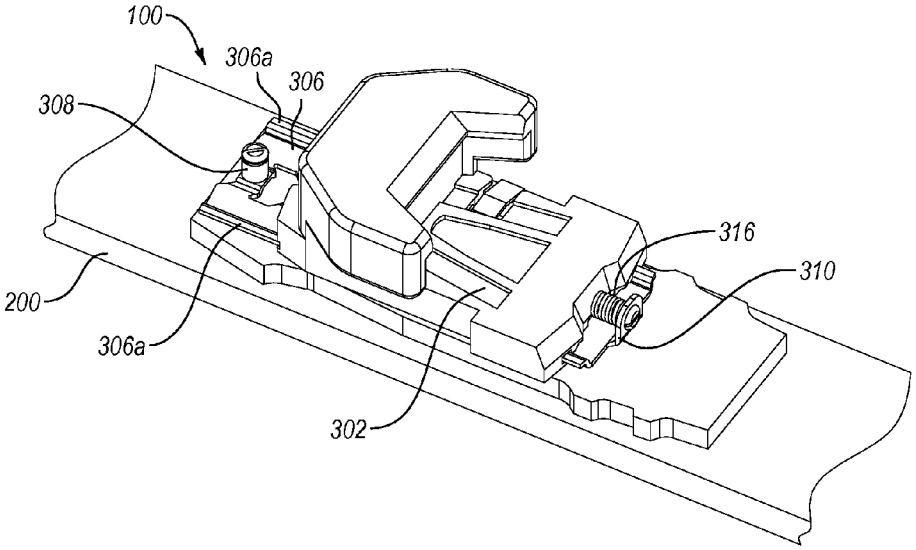
FIG. 2 is a side view of a toe piece of a ski binding.
Figure 3:
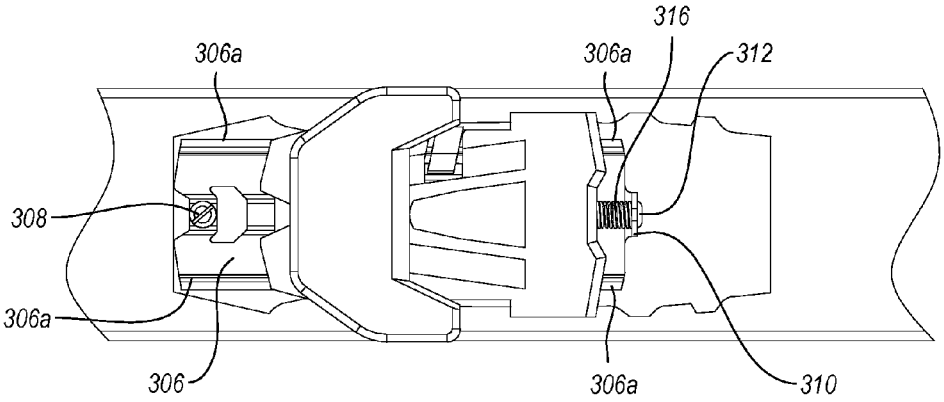
FIG. 3 is a top view of a toe piece of a ski binding.

In general, embodiments of the invention are concerned with ski bindings and, more particularly, with ski bindings that can be remotely operated to release a locked in ski boot at any time upon the initiative of the user. This release function of the ski binding can be effected remotely by a user with an electronic remote control. The remote control can be implemented in a variety of mechanisms, such as a key fob, ski pole, or smartphone, for example.

The ski binding may, in some embodiments at least, be an otherwise conventional alpine ski binding that includes a toe piece configured for releasable engagement with an arm located beneath the toe piece. The arm may be moved with a servomotor, that may be electrically powered, or other motor that is controlled by the electronic remote control. When the arm is engaged with the toe piece, the toe piece is prevented from moving along a longitudinal axis of the ski, so that a boot locked into the ski binding remains locked in while the arm and toe piece are thus engaged. When the arm is disengaged from the toe piece, as a consequence of the remote activation of the servomotor or other motor, a biasing element engaged with the toe piece causes the toe piece to move away from the heel piece of the binding, thus increasing the longitudinal spacing between the toe piece and the heel piece so that a ski boot previously locked into the binding is thus freed from the binding. A cocking mechanism enables the user to move the toe piece back into a position where the ski boot can once again be locked into the ski binding.

A. General Aspects of Some Example Embodiments

In general, the ski bindings, skis, ski poles, and remote release mechanisms disclosed herein, may be constructed with a variety of components and materials including, but not limited to, adhesives, plastic, rubber, metal, fiberglass, composites, polytetrafluouroethylene (PTFE), carbon fiber, and any combination of these. Suitable metals may include brass, steel, titanium, aluminum, and aluminum alloys, although the skilled person will understand that a variety of other metals may be employed as well and the scope of the invention is not limited to the foregoing examples. These construction materials can be employed in connection with a variety of processes including, but not limited to, milling, injection molding, or die casting.

Depending upon the material(s) employed in the construction of the skis, ski bindings, ski poles, and remote release mechanisms, a variety of methods and components may be used to connect, releasably or permanently, various elements of the aforementioned devices. For example, the various elements of a ski binding within the scope of this disclosure may be attached to each other by any one or more of processes such as welding or brazing, and/or mechanically by way of fasteners such as bolts, screws, pins, and rivets, for example.

Some, none, or all of portions of a one or more of the skis, ski bindings, ski poles, and remote release mechanisms and their components may be coated with paint, super-hydrophobic coatings, or other materials. At least some of such materials may serve to help prevent, or reduce, rust and corrosion. Surface treatments and textures may also be applied to portions of the skis, ski bindings, ski poles, and remote release mechanisms. Such surface treatments can be configured and employed for circumstances where low friction is required between moving or movable parts, and also where relatively high friction, or resistance to motion, is required between moving or movable parts.

B. General Aspects of an Example Ski Binding

With reference now to FIG. 1, an example ski assembly 100 includes a ski 200 to which a binding 300 is attached. The binding 300 is releasably engaged with a ski boot 350. In this particular example, the binding 300 is an alpine ski binding, and the ski boot 350 is an alpine ski boot. In other embodiments however, the binding 300 could be an alpine touring (AT) ski binding, a telemark ski binding, or a cross-country ski binding. Likewise, the ski boot 350 could be an AT boot, a telemark boot, or a cross-country boot. Thus, the scope of the invention is not limited to any particular ski boot or ski binding type. Likewise, the scope of the invention is not limited to any particular ski 200 type and some example skis that can be employed with embodiments of the invention include backcountry touring skis, racing skis, and cross-country skis.

As further indicated in FIG. 1, the binding 300 includes a toe piece 302 and heel piece 304 that are each mounted to the ski 200 and cooperate with each other to releasably retain the ski boot 350. Except as noted herein, the binding 300 can be a conventional step-in alpine ski binding. In at least some embodiments, the binding 300 is a so-called 'demo' binding of the type often used by rental shops. Because these demo bindings may be used by a variety of different skiers, the demo bindings are highly adjustable in terms of the ski boot sole lengths that they can accommodate. By way of example, some demo bindings can be adjustable by as much as about 100 mm, or more. This adjustability can be enabled by movement of the toe piece and/or the heel piece. That is, in a demo binding, the longitudinal position, along the ski, of the toe piece and/or heel piece may be adjustable. In contrast, non-demo bindings, which may be referred to herein as substantially non-adjustable ski bindings, may be only minimally adjustable in terms of the ski boot sole lengths that they can accommodate. The scope of the invention extends to both demo ski bindings and non-demo ski bindings.

C. Aspects of an Example Toe Piece and Binding Plate

With reference now to FIGS. 2-6, further details are provided concerning an example toe piece of a ski binding, such as the toe piece 302 of FIG. 1. As indicated in those Figures, the toe piece 302 includes a pair of engagement elements 302*a* that are configured to slidingly interface with engagement elements 306*a* of a binding plate 306 so that the toe piece 302 can move back and forth on the binding plate 306 along a longitudinal direction of the ski 200. As discussed in more detail below, the binding plate 306 can be configured to constrain the movement of the toe piece 302 over a range of motion defined by the binding plate 306 and associated components.

In the illustrated example, the engagement elements 302*a* are each in the form of a track, and the engagement elements 306*a* are each in the form of a rail that is received in a corresponding track. These structures are presented only by way of example however, and any other arrangement that enables the toe piece 302 to move back and forth on the binding plate 306 along a longitudinal direction of the ski 200, while also preventing vertical motion of the toe piece 302 upward away from the ski 200 and preventing lateral motion of the toe piece 302, can alternatively be employed. For example, in one alternative embodiment, the respective configurations of the engagement elements 302*a* and 306*a* can be reversed. That is, in this alternative embodiment, the engagement elements 302*a* are each in the form of a rail, and the engagement elements 306*a* are each in the form of a track that slidingly receives a corresponding rail.

It was noted above that the binding plate 306 can be configured to constrain the movement of the toe piece 302. Thus, in some example embodiments, a front stop 308 can be provided near the front of the binding plate 306. In general, the front stop 308 serves to limit the range of forward motion of the toe piece 302 along the binding plate 306. While the front stop 308 can take any suitable form consistent with its function, the illustrated embodiment of the front stop 308 includes a fastener 308*a*, such as a machine screw or bolt for example, that passes through a sleeve 308*b* and engages threads defined in the binding plate 306. If there is a need to remove the toe piece 302 from the binding plate 306, the front stop 308 can be removed, and the toe piece 302 then slid off the binding plate 306.

With continued reference to FIGS. 2-6, the binding plate 306 can also be configured to constrain the movement of the toe piece 302 in a backwards direction, that is, in a direction away from the front of the ski 200. For example, a rear stop 310 can be provided near the rear of the binding plate 306. In some embodiments, the rear stop 310 is integral with the binding plate 306, although that is not required. In any case, the front stop 308 and rear stop 310 cooperate with each other to collectively define a longitudinal, that is, along the length of the ski 200, range of motion over which the toe piece 302 is constrained to move.

As further indicated in the Figures, the rear stop 310 can include an opening through which a post 312 extends toward the back of the toe piece 302. The post 312 can be a rivet, bolt, screw or similar item. Where the post 312 is threaded, the opening defined by the rear stop 310 can include corresponding threads with which to engage the post 312. A sleeve (not shown) may be provided, but is not necessarily required, that is fitted onto the post 312. Whether or not a sleeve is provided, a biasing element 316, such as a helical spring for example, is disposed about the post 312 and serves to help maintain the position and orientation of the biasing element 316 for various different positions of the toe piece 302. In general, and as discussed in more detail below, the biasing element 316 is configured and arranged to exert a biasing force on the toe piece 302 so that when the toe piece 302 is disengaged from the binding plate 306, the toe piece 302 will move toward the front of the ski 200 under the influence of the biasing element 316. In some embodiments, the toe piece 302 can include a recess in which an end of the biasing element 316 is received. In yet other embodiments, the biasing element 316 can be attached to the toe piece 302. As well, in some embodiments, the front stop 308, rear stop 310, sleeve, and biasing element 316 could all be located within a housing, such as housing 402 discussed elsewhere herein.

Figure 4:
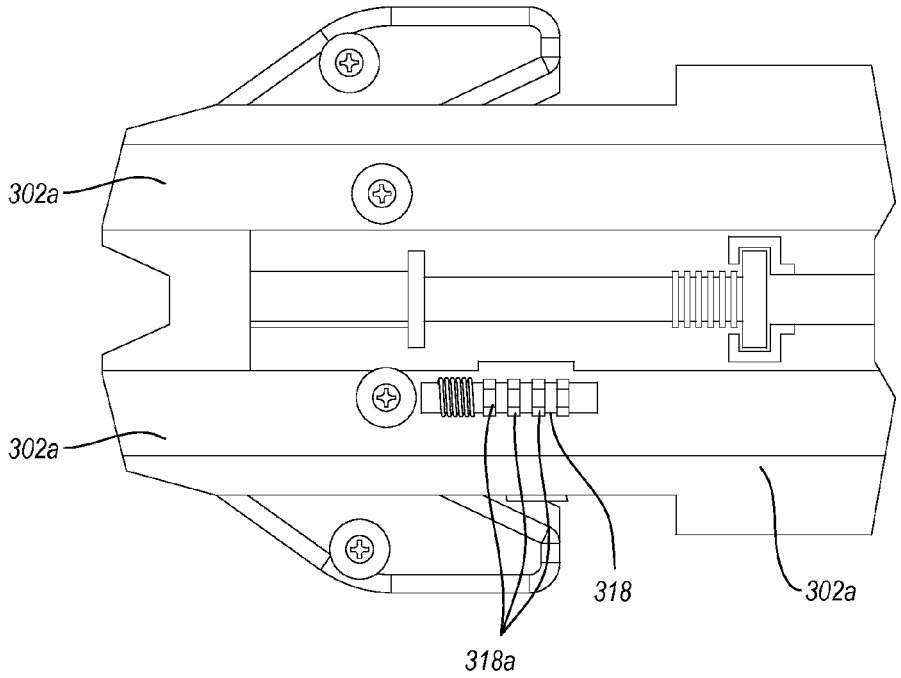
FIG. 4 is a bottom view of a toe piece of a ski binding.
Figure 5:
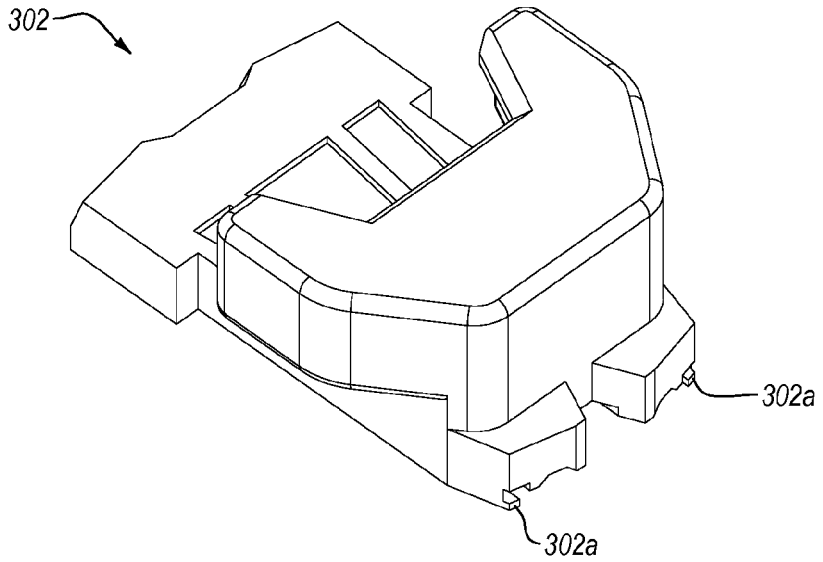
FIG. 5 is a front perspective view of a toe piece of a ski binding.
Figure 6:
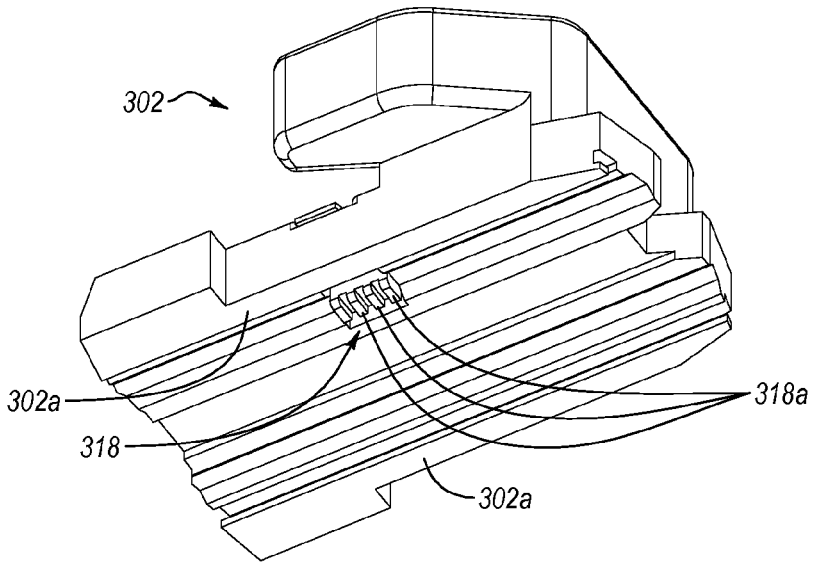
FIG. 6 is a bottom perspective view of a toe piece of a ski binding.
Figure 7:
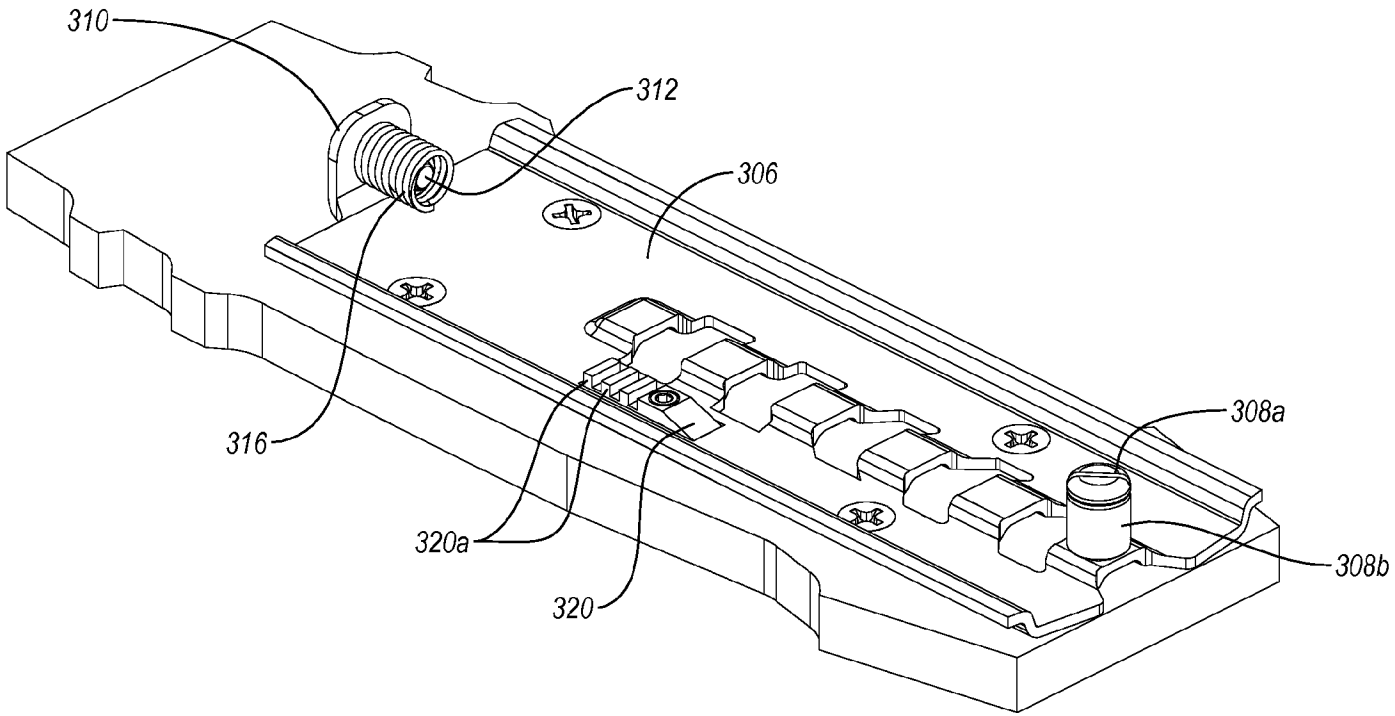
FIG. 7 is a top perspective view of a binding plate.

With particular reference now to FIGS. 4 and 6, the toe piece 302 also includes, on its underside, a toothed locking element 318. The toothed locking element 318 can be a separate element from the toe piece 302, as shown, or the toothed locking element 318 can be integral with the toe piece 302. In at least some embodiments, the position of the toothed locking element 318 within the toe piece 302 is adjustable such that the locking element 318 can be moved both forward and rearward within the toe piece 302. Once positioned as desired, the locking element 318 can then be releasably locked into place. This configuration enables placement of the toe piece 302 at a desired position relative to the binding plate 306, and thus enables the binding 300 to be adjusted for a variety of different ski boot 350 sole lengths.

In the illustrated embodiment, the locking element 318 of the toe piece 302 is configured to releasably engage the rotatable arm 320. In particular, the locking element 318 includes a plurality of teeth 318*a* that can interleave with corresponding teeth 320*a* of a rotatable arm 320 so as to prevent movement of the toe piece 302 when the locking element 318 is engaged with the rotatable arm 320, as discussed in more detail below. In general however, when the locking element 318 is engaged with the arm 320, forward movement and rearward movement of the toe piece 302 along the binding plate 306 are prevented, and when the locking element 318 and arm 320 are disengaged from each other, the toe piece 302 is free to move forward along the binding plate 306 toward the front of the ski 200, until prevented from further movement by the front stop 308.

D. Example Retention and Release Assembly

With attention now to FIGS. 7-10, further details are provided concerning a ski binding control and release assembly, one example of which is denoted generally at 400. For simplicity, the ski binding retention and release assembly 400 may be referred to herein simply as a 'retention and release assembly.'

Figure 8:
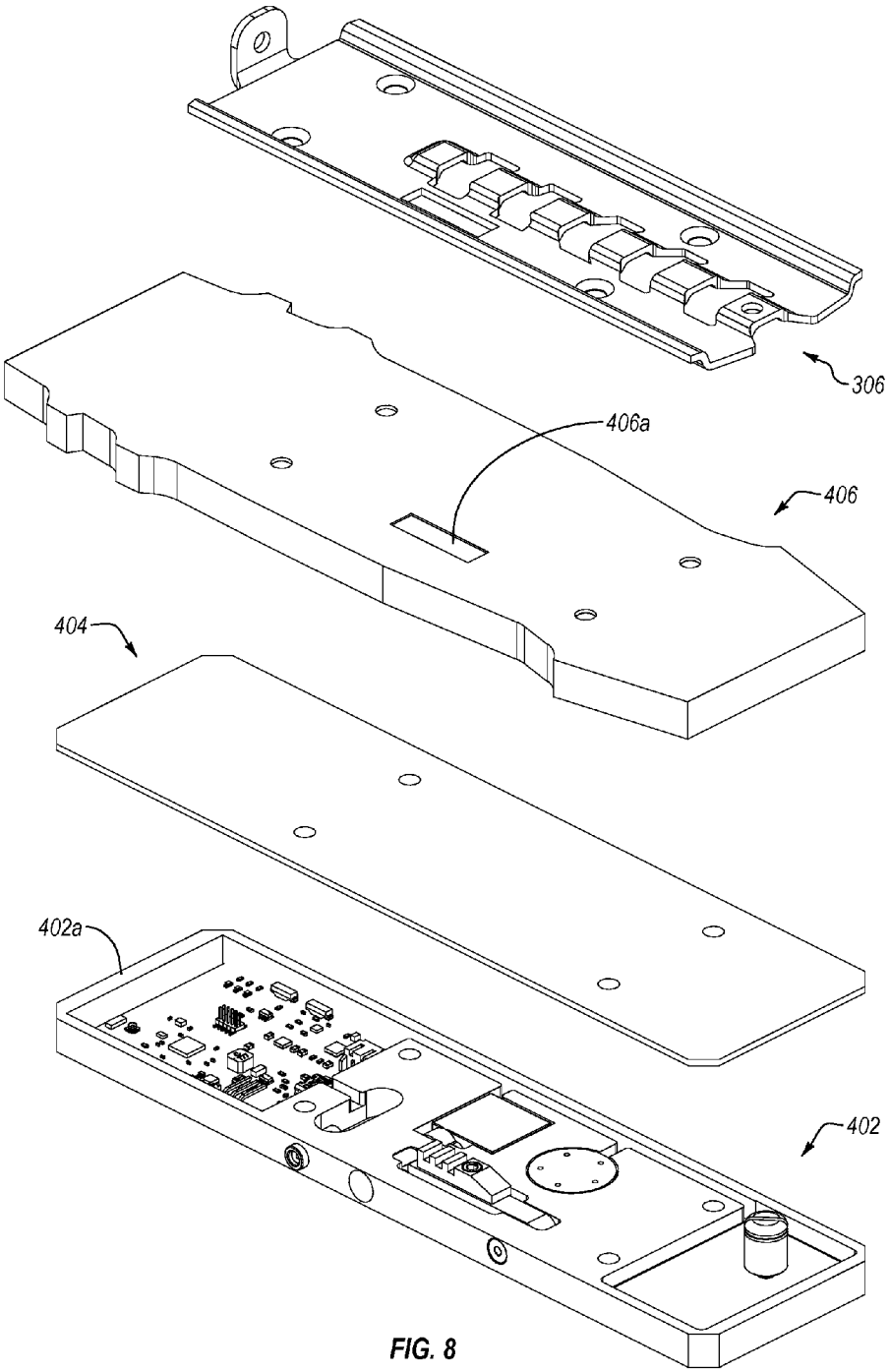
FIG. 8 is an exploded view of a ski binding control and release assembly.
Figure 9:
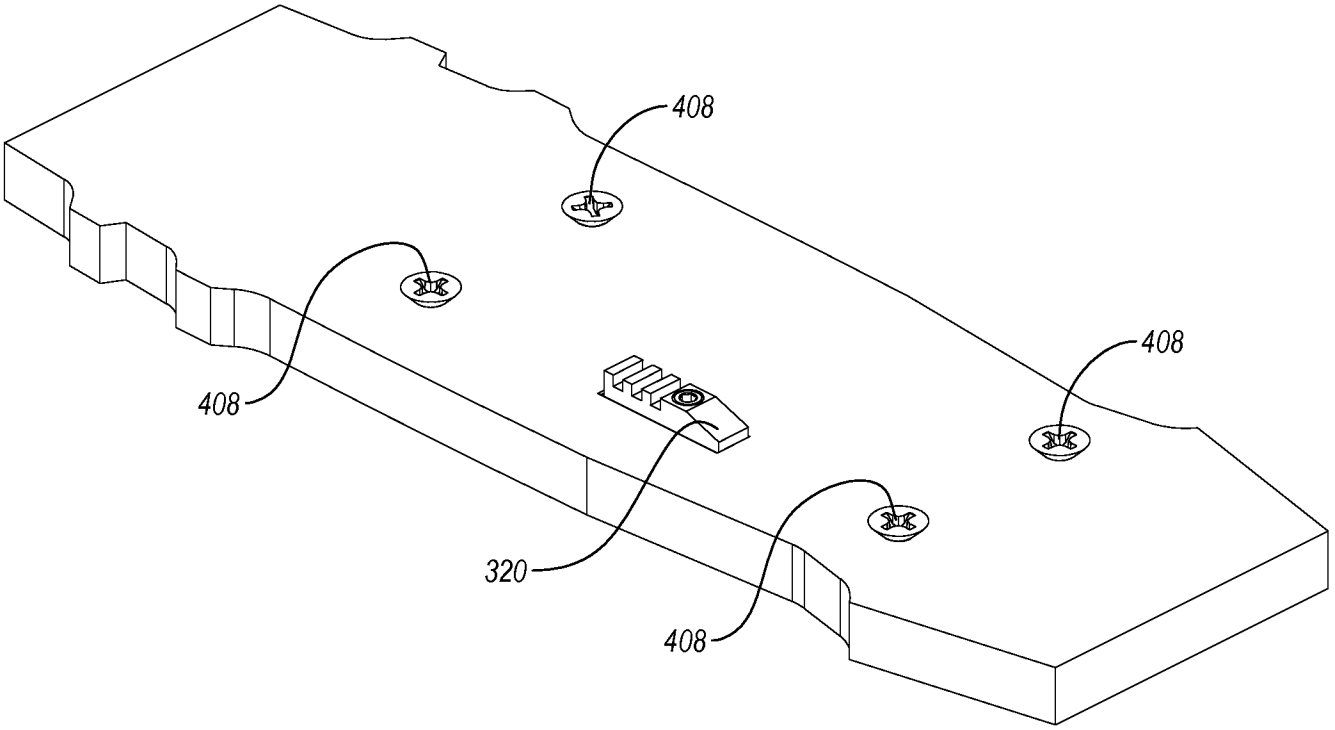
FIG. 9 is a perspective view of a cover of a ski binding control and release assembly.
Figure 10:
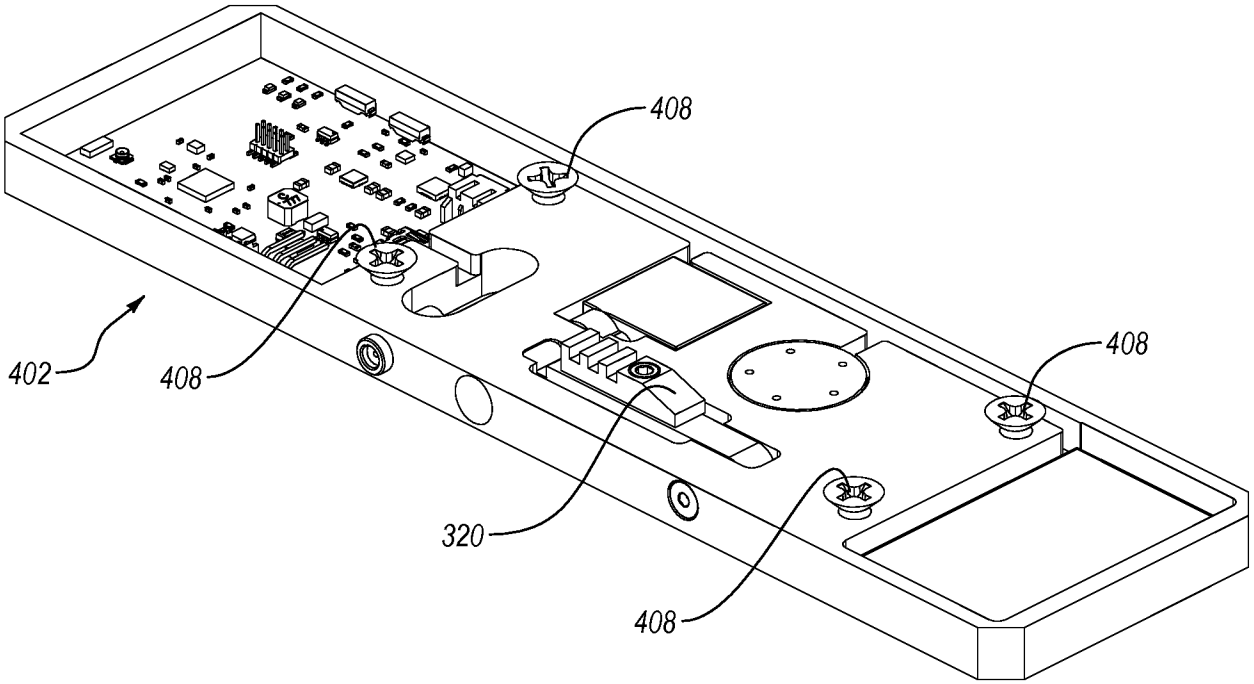
FIG. 10 is a perspective view of a sealing element.
Figure 11:
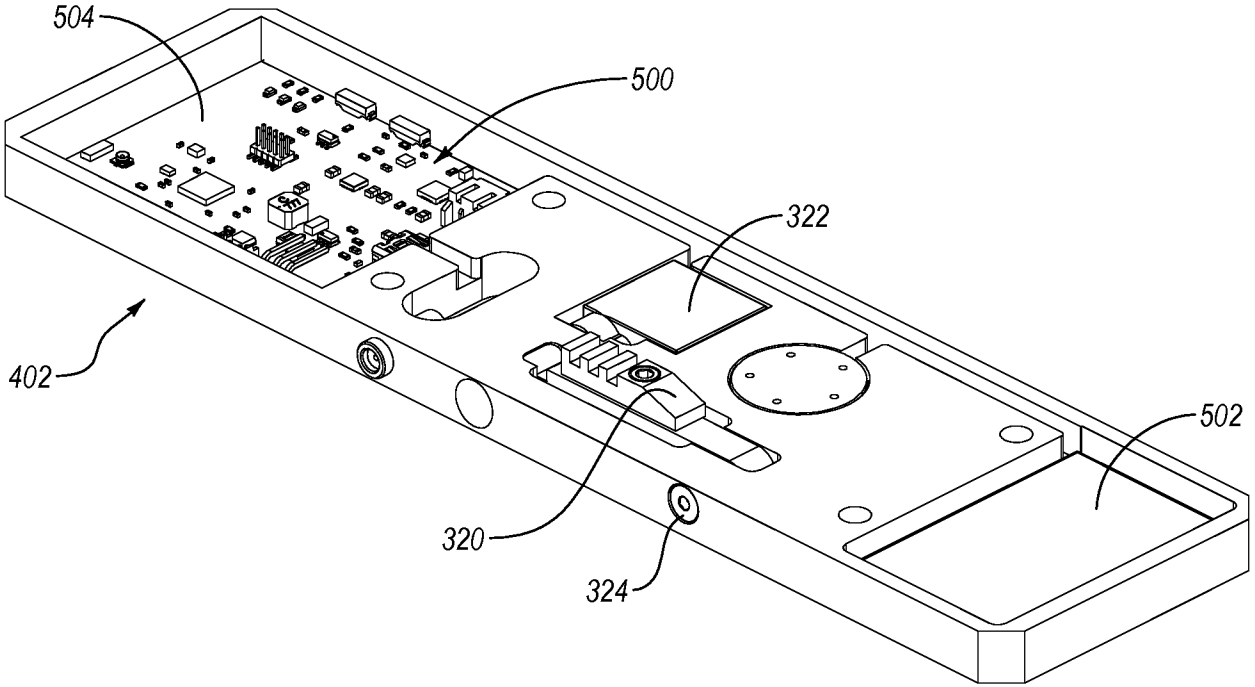
FIG. 11 is a perspective view of a housing.

As best shown in FIG. 8, the retention and release assembly 400 generally includes a housing 402 within which various components, discussed below, are housed, a sealing element 404 configured and arranged to help prevent ingress of snow, water, ice and other foreign matter into the housing 402, and a cover 406 which, among other things, holds the sealing element 404 in place on the housing 402. The housing 402 can be made from any of a variety of materials including, for example, machined metal, such as aluminum for example, or injection molded plastic. More generally, the housing 402 could be made of any one or more of plastic, metal, rubber, carbon fiber, or composite material, and the scope of the invention is not limited to any particular material(s) or combination of materials. As best shown in FIGS. 11, the housing 402 can include a variety of recesses and openings for accommodating electronic components, power connections, and other elements. Such elements can include elements of a control system 500, discussed in more detail below. Any space remaining in the recesses and openings after components have been positioned therein can be filled with resin, electronics potting compound, or similar materials.

The sealing element 404 can be made of plastic, rubber, such as latex rubber for example, and/or any other suitable materials and, in general, has a shape and size that is substantially the same as defined by the outer walls 402*a* of the housing 402. The sealing element 404 should substantially maintain its flexibility and pliability even when exposed to low temperatures, such as about 32 F and below, so that ingress of foreign materials into the housing 402 can be prevented in a range of environmental conditions. While not specifically shown in FIG. 8, the sealing element 404 may include an opening, or openings, through which fasteners 408 can extend. Examples of such points of ingress for fasteners are shown in FIG. 14, discussed below.

The cover 406 can be configured to completely enclose the top and sides of the housing 402. Among other things, the cover 406 defines an opening 406*a* through which a portion of the arm 320 can extend (see, e.g., FIGS. 8 and 9). The cover 406 can be made of plastic, metal, and/or any other suitable materials. The cover 406 need not form a seal with the upper surface of the ski 200 since the sealing functionality is provided by way of the sealing element 404. As indicated in the Figures, a plurality of fasteners 408 hold the stack of elements, namely, the housing 402, sealing element 404, cover 406, and binding plate 306, in position on the ski 200. The fasteners 408 can be removable elements, such as screws or bolts for example, to enable access to elements in the housing 402, replacement of the sealing element 404, and/or for any other suitable purposes. In some embodiments, the sealing element 404 is only provided in the area of the teeth 320*a* and servomotor 322.

Figure 12:
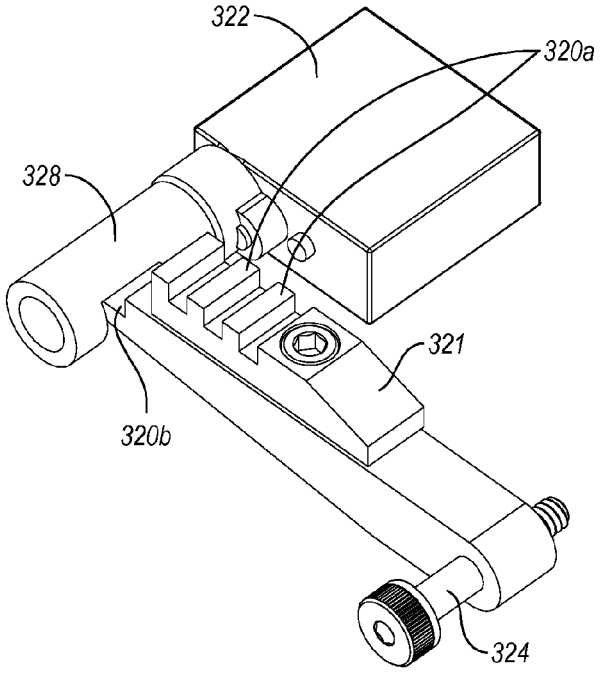
FIG. 12 is a detail view of an arm, actuator element, and motor.
Figure 13:
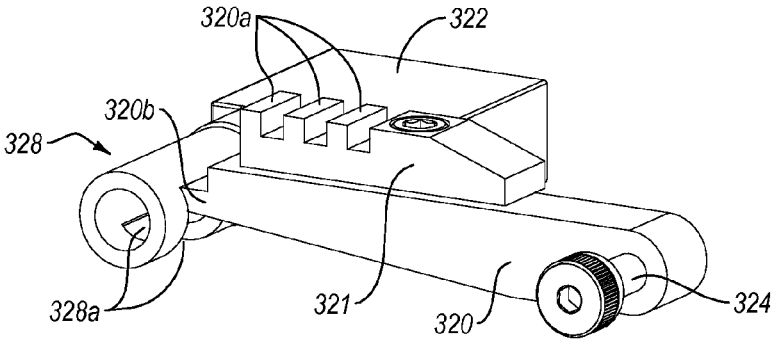
FIG. 13 is a detail view of an arm, actuator element, and motor.
Figure 14:
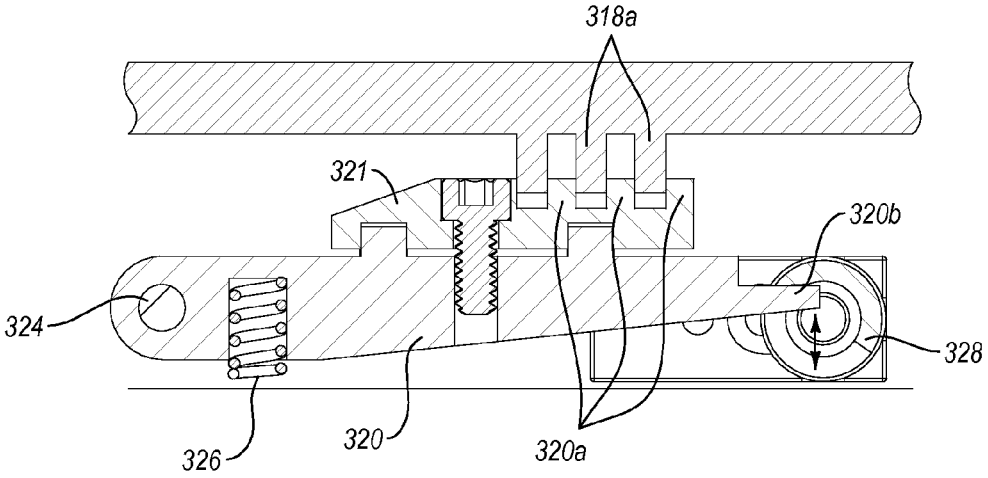
FIG. 14 is a detail view showing the engagement of an arm and ski binding toe piece.

With particular reference now to FIGS. 12-14, further details are provided concerning the structure and operation of the arm 320. As indicated, the arm 320 includes an engagement element 321 that may be removably connected to the body of the arm 320. The engagement element 321 includes the teeth 320*a*, discussed earlier in connection with FIGS. 4 and 7, for example. As best shown in FIG. 14, the teeth 320*a* can releasably engage, by interleaving for example, the teeth 318*a* of the locking element 318. As a result, forward motion of the locking element 318 and toe piece 302, that is, to the right in FIG. 14, is prevented when the teeth 318*a* and 320*a* are engaged as shown. On the other hand, when the teeth 318*a* and 320*a* are not engaged with each other, forward motion of the locking element 318 and toe piece 302 can occur.

As further indicated in FIG. 14, arm 320 is rotatable about a pin 324 that is received in the housing 402. In at least some embodiments, the pin 324 is threaded and engages corresponding threads in the housing 402. As such, the pin 324 can include a hex recess in the top, or other structure, to enable use of a tool, such as an Allen wrench for example, to tighten and loosen the pin 324. The pin 324 and arm 320 can be metal, such as steel for example, or any other suitable materials. As further indicated in the Figures, the arm 320 can be biased toward a particular position and orientation by way of a biasing element 326, which may be a helical spring for example. In the example of FIG. 14, the biasing element 326 exerts an upward biasing force on the arm 320 which maintains the arm 320 in the indicated position unless or until the arm 320 is acted upon by another force.

In more detail, the biasing element 326, which is positioned in the housing 402, tends to move the arm 320 upward so that the teeth 320*a* engage the teeth 318*a*. This may be referred to herein as a locked state of the toe piece 302 since forward movement of the toe piece 302 is prevented by the interlocking of the teeth 320*a* and the teeth 318*a* with each other. The sealing element 404 may include an opening through which the teeth 320*a* can protrude.

With continued reference to FIGS. 12-14, provision is made for selectively moving the arm 320 downwards, notwithstanding the influence of the biasing element 326. In particular, the servomotor 322 includes an output shaft that is connected with an actuator element 328 that is operably engaged with the arm 320. In the illustrated example, the actuator element 328 is generally in the form of a hollow cylinder that defines a window 328*a* in which an end 320*b* of the arm 320 is received. As shown, the window 328*a* extends part way about the circumference of the actuator element 328, and has a width that is the same, or substantially the same, as the width of the end of the arm 320. It should be noted that the actuator element 328 and the arm 320 remain engaged with each other regardless of whether the locking element 318 and arm 320 are engaged with each other or not. In some embodiments, a gear motor drive is used instead of the servomotor 322. The gear motor drive may be particularly useful when used in connection with bindings that have a relatively high DIN setting range.

In operation, and as shown in FIG. 14, the edge of the window 328*a* may initially be in contact with the end 320*b* of the arm 320. As such, a clockwise rotation of the actuator element 328, caused by activation of the servomotor 322, overcomes the bias imposed by the biasing element 326 and rotates the arm about the pin 324 downward, thereby disengaging the teeth 320*a* from the teeth 318*a* of the toe piece 302. This may be referred to herein as an unlocked state of the toe piece 302 since forward movement of the toe piece 302 is made possible by the disengagement of the teeth 320*a* and the teeth 318*a* from each other. As noted earlier, this forward movement can be positively effected by the influence of the biasing element 316.

As the foregoing suggests, the period of operation of the servomotor 322 may be quite brief. In particular, the servomotor 322 may operate only long enough to effect disengagement of the teeth 320*a* from the teeth 318*a*. When that operation has been completed, power to the servomotor 322 can be cut off. Since the servomotor 322 is no longer in operation, and the toe piece 302 has been pushed forward by the biasing element 316, the biasing element 326 is now free to act on the arm 320 and tends to move the arm 320 up into the position "1" indicated in FIG. 15. As further indicated in FIG. 15, a recocking operation can then be performed by the user to move the toe piece 302 back into the locked state shown in FIG. 15.

Turning now to FIGS. 15*a*-15*d*, details are provided concerning a recocking operation that can be employed by a user to move the toe piece 302 into a locked state after the toe piece 302 has been moved to an unlocked state. As shown in the position "1" of FIG. 15*a*, the toe piece 302, to which the locking element 318 is attached, has moved forward toward the tip of the ski 200 so that the locking element 318 is displaced in a forward direction, that is, to the right in FIG. 15*a*, relative to the arm 320, whose location relative to the tip of the ski 200 is fixed. As a result of this movement of the toe piece 302, which has taken place as a result of the action of the servomotor 322 on the arm 320, the locking element 318 and arm 320 are disengaged from each other.

Figure 15A:
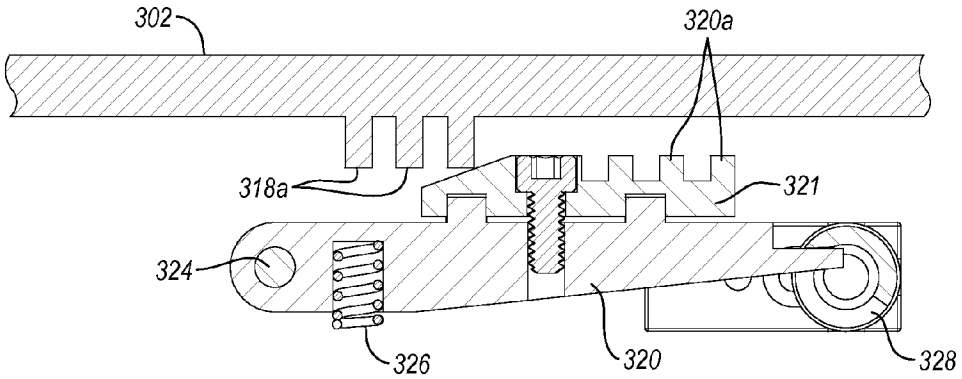
FIGS. 15*a*-15*d* disclose a re-cocking process for a ski binding toe piece.
Figure 15B:
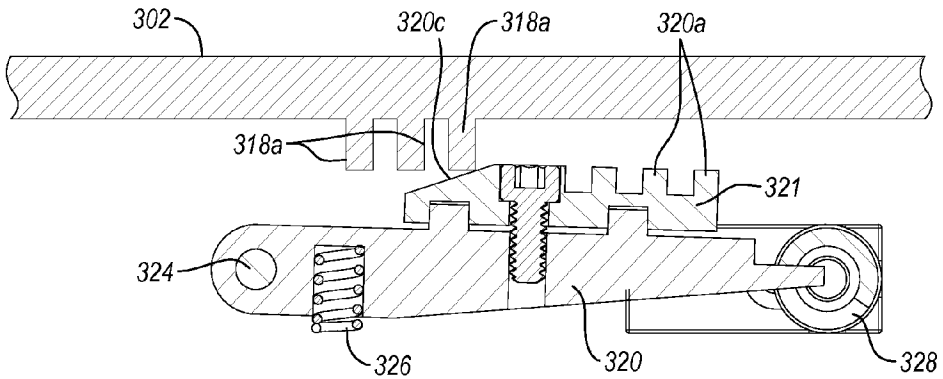
Figure 15C:
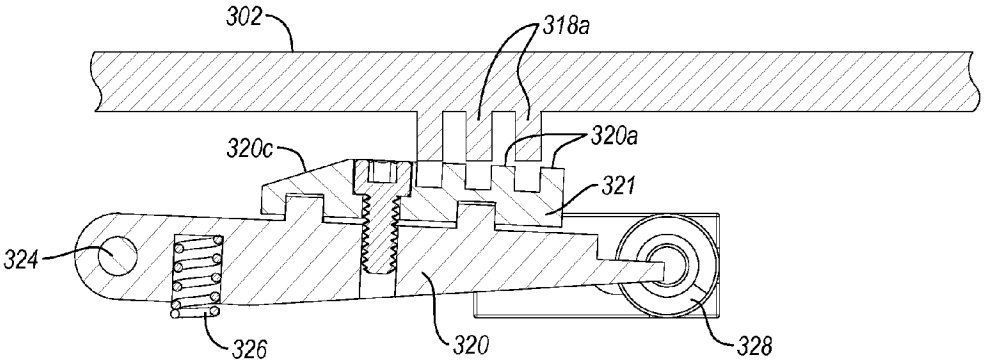

The recocking operation can commence with movement of the toe piece 302 to the position "2" of FIG. 15*b*. In general, this operation can involve a reverse cam motion, that is, conversion of a linear motion of the toe piece 302 into a rotary motion of the arm 320. More specifically, as the leading tooth 318*a* of the locking element 318 moves rearward under the influence of the hand of the user, the leading tooth 318*a* slidingly engages a ramp 320*c* of the arm 320. Because the arm 320 is rotatable about pin 324, the ramp 320*c* provides little or no resistance to the rearward motion of the leading tooth 318*a*. Instead, the ramp 320*c* is rotated downward against the bias imposed on the arm 320 by the biasing element 326, out of the path of the leading tooth 318*a*, thus enabling the locking element 318 to pass by the ramp 320*c* into position "3" shown in FIG. 15*c*.

Figure 15D:
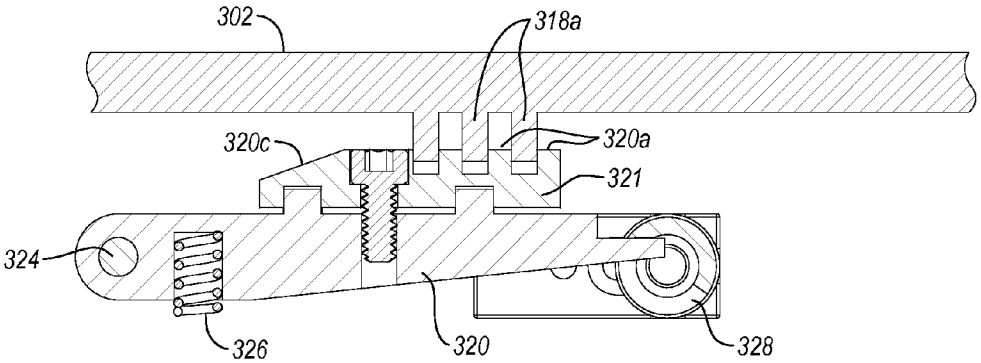

The rearward motion of the toe piece 302 is constrained by the rear stop 310 and biasing element 316 (see, e.g., FIG. 3), and when the toe piece 302 has reached its rearmost position, indicated by position "4" in FIG. 15*d*, the teeth 318*a* are aligned with gaps between the teeth 320*a* and, as a result, the arm 320 is able to rotate upward, under the influence of the biasing element 326, unimpeded, until the teeth 318*a* and teeth 320*a* are engaged with each other. The toe piece 302 is now in the cocked position once again.

In connection with the foregoing, it should be noted that the locking element 318, arm 320, actuator element 328, and servomotor 322 collectively comprise an example structure implementation of a means for selectively retaining and releasing a toe piece of a binding. The scope of the invention is not limited to this example structural implementation however, and any other structure(s) capable of performing the same, or similar, functionality are considered to fall within the scope of the invention.

E. Example Remote Release Control System

Figure 16A:
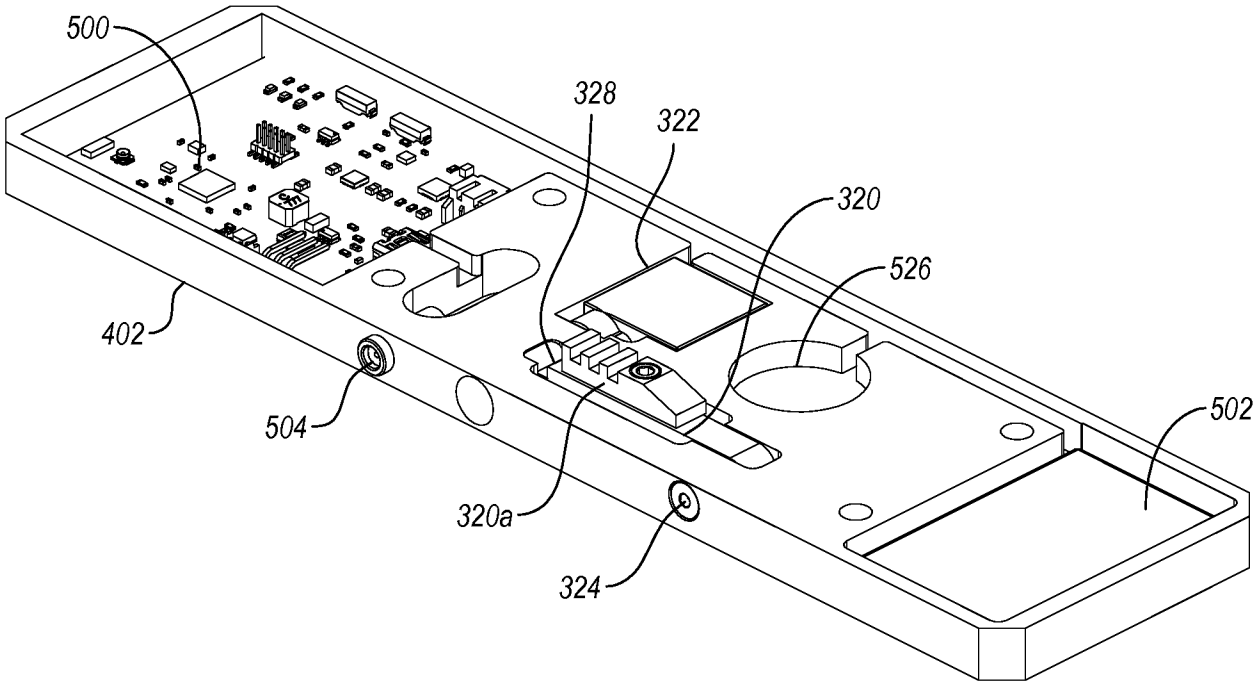
FIG. 16*a* is a detail perspective view of aspects of a housing.
Figure 16B:
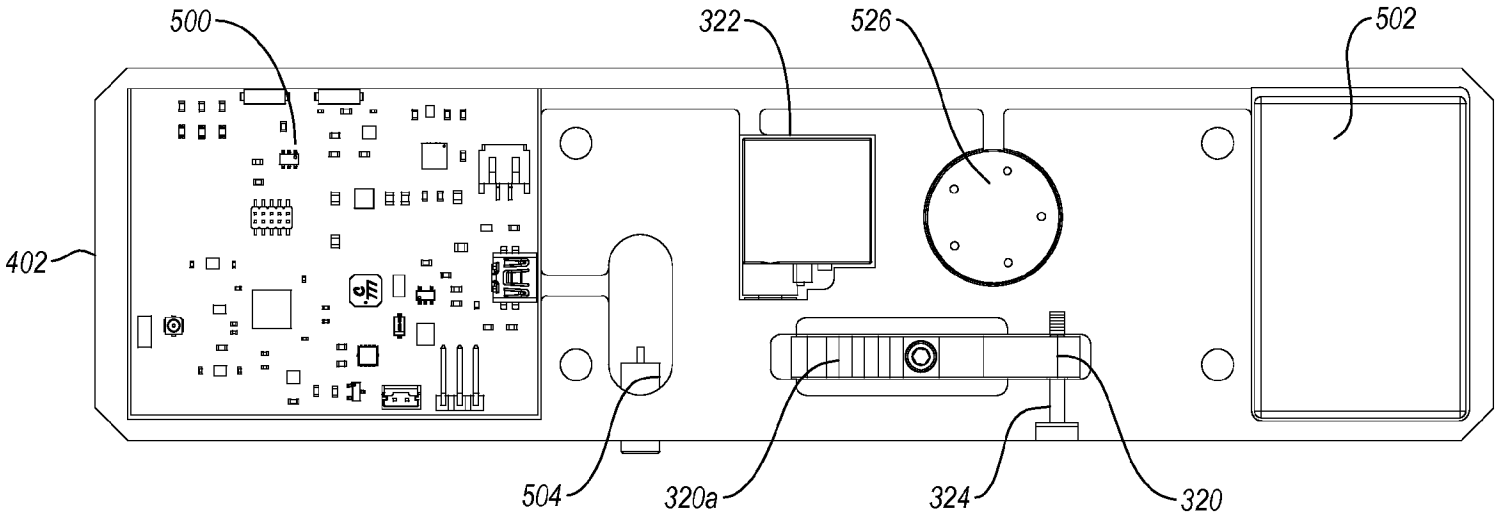
FIG. 16*b* is a detail plan view of aspects of a housing.
Figure 17:
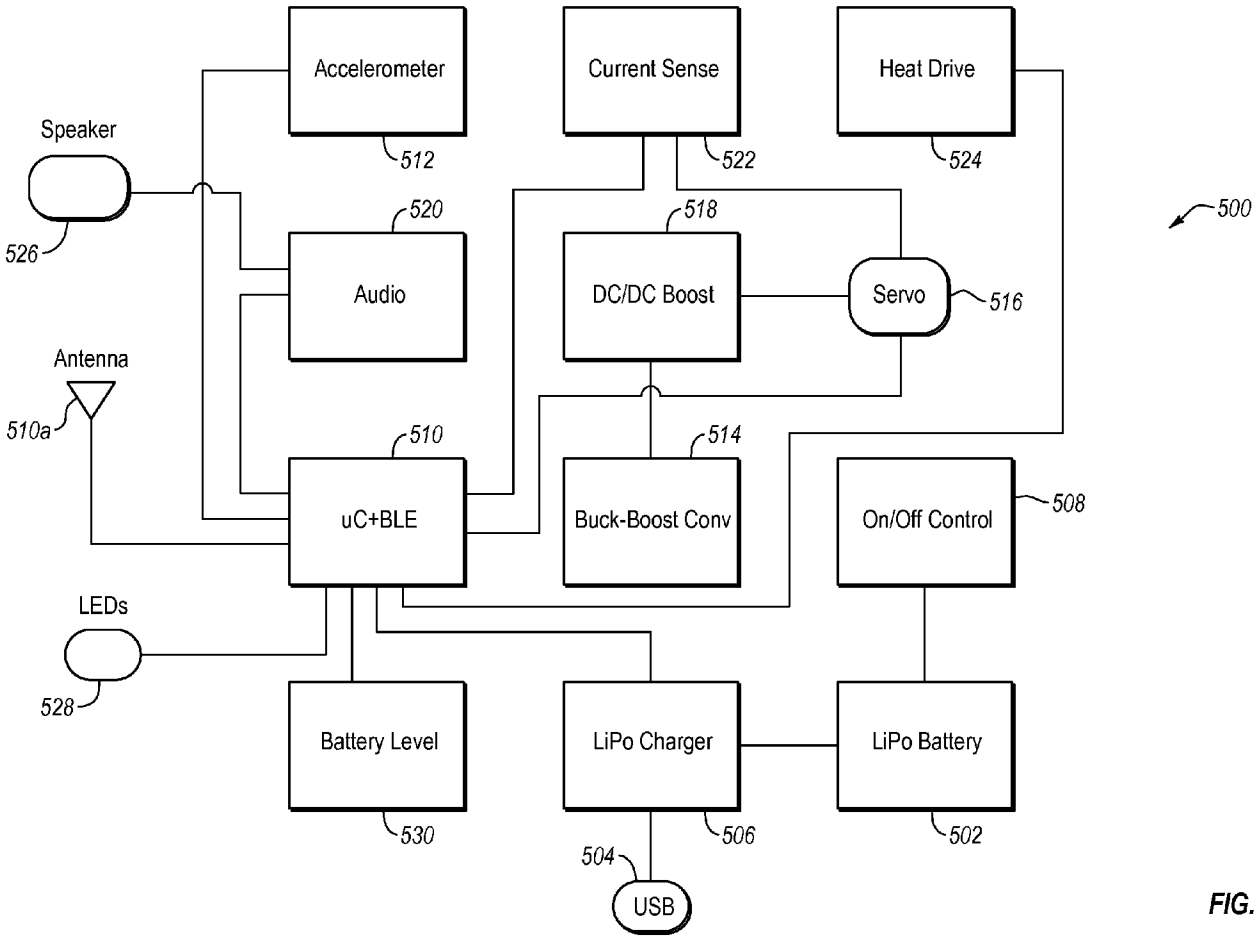
FIG. 17 is a block wiring diagram of an example control system.

With attention now to FIGS. 16*a*, 16*b* and 17, further details are provided concerning aspects of a control system for remote release of a toe piece. On example embodiment of a control system, briefly noted above, is denoted at 500. As shown in the Figures, a power source 502 may be provided that can take the form of a rechargeable battery, such as an LiPo battery for example. This can be a single Li-polymer battery which, when fully charged, provides about 4.2 Vdc. The power source 502 can be charged by way of a charging port 504 that is arranged for electrical communication with the power source 502. The charging port 504 can have any suitable configuration, one example of which is a Universal Serial Bus (USB) interface.

An LiPo controller 506 is provided that is a stand-alone system load sharing and Li-Ion/Li-Polymer battery charge management controller. This control block employs a constant current/constant voltage (CC/CV) charge algorithm with selectable charge termination point. As well, the LiPo controller 506 provides LiPo battery status to the microcontroller. The LiPo controller is supplied charge current or power from the charging port 504.

With continued reference to FIG. 17 in particular, an On/Off circuit 508 is provided that may initially be powered off and, in this condition, may draw only about 7 mic-amps. This relatively low current draw allows the control system 500 to remain for long periods in the off condition. Power may be turned on by applying a magnet, which could be embedded in a device carried by a user, to a magnetic reed switch. The magnet may, in general, be an element of a device carried by a user. For example, the various fobs or other hand-held devices disclosed herein may include a magnet or magnetic element that a user can bring into proximity with the On/Off Circuit 508 for activation. In another embodiment, the magnet or magnetic element could be located on or in a ski pole which the user could then use to activate the On/Off Circuit 508.

In any case, once the power is on, the On/Off circuit 508 can be powered down later by, for example, sending a message via the BLE stack from a Blue Tooth Smart Application to a microcontroller 510 such as the on-board uC+BLE solution on a chip (SOC). The microcontroller 510 can include an antenna 510*a* by way of which wireless signals can be received from a remote device, such as a key fob or ski pole of a user, discussed in more detail below.

The device can also include a timer which enables the device to turn itself off independently when there is no activity within a defined period of time detected from the on-board accelerometer 512 via the microcontroller. As indicated in FIG. 17, the accelerometer 512 interfaces with the microcontroller 510 via a two wire interface (TWI). Among other things, the accelerometer 512 can implement numerous functions in connection with the binding 300, examples of which include, but are not limited to, orientation of the binding 300 in 3D space, activity detection, and positive and negative acceleration of the binding 300.

The control system 500 can further include a buck-boost converter 514 that produces, for example, a DC output of about 3.3V. The output voltage magnitude that is either greater than or less than the input voltage magnitude which is supplied from the Li-polymer battery 502. This supplies a regulated 3.3 Vdc to the microcontroller 510 and other support circuitry.

As noted earlier, embodiments of the invention can include a servomotor 516 that is powered by the DC/DC boost circuit block 518, which can provide the servomotor 516 with about 5 Vdc, for example. That is, the DC/DC boost circuit block 518 converts the 3.3 Vdc output from the buck-boost converter 514 to 5.0 Vdc. The 5.0 Vdc out is used by an audio circuit 520 and the servomotor 516. In more detail, actuation of the servomotor 516 is achieved by sending the servomotor 516 control pulses from the microcontroller 510, which causes the servomotor 516 (denoted at 322 in FIGS. 12-13) to move the actuator element (e.g., the actuator element 328 in FIGS. 12-14) as described earlier to enable the toe piece 302 to move forward.

With continued reference to FIG. 17 in particular, the control system 500 may include current sensing capabilities. To this end, a current sense module 522, which can be in the form of a high side current sense amplifier for example, is used to detect a servomotor 516 stall condition that may be an indication that the binding retention and release assembly is locked or has malfunctioned in some way. This could occur, for example, if the toe piece 302 is prevented from moving, or has become damaged to the extent that it cannot move, or could occur as a result of water accumulating and freezing inside the housing 402.

A heat drive circuit 524 may also be provided that is used to provide heat to the binding retention and release assembly if a stall condition is detected. This function may be particularly useful where the stall condition has occurred as a result of ice or snow buildup.

Finally, embodiments of the invention can use a variety of devices to provide feedback that is perceptible by one of the senses of a user. For example, the audio circuit 520 can operate to amplify Pulse Width Modulation (PWM) signals from the microcontroller 510. In this way, the audio circuit 520 can generate audible alerts or indications that are transmitted by way of a speaker 526. Similarly, one or more light sources 528, such as a Light Emitting Diode (LED) are used to provide visual indications and alerts such as low battery condition, which is monitored by the battery level module 530, and low radiated signal strength (RSSI). As well, a low battery condition may also trigger generation of an audible signal on a periodic, or other, basis. In one example embodiment, the audible signal may be generated about every 5 seconds as a result of a low battery condition, although different time intervals could alternatively be used.

F. Example Remote Control Devices

Figure 18A:
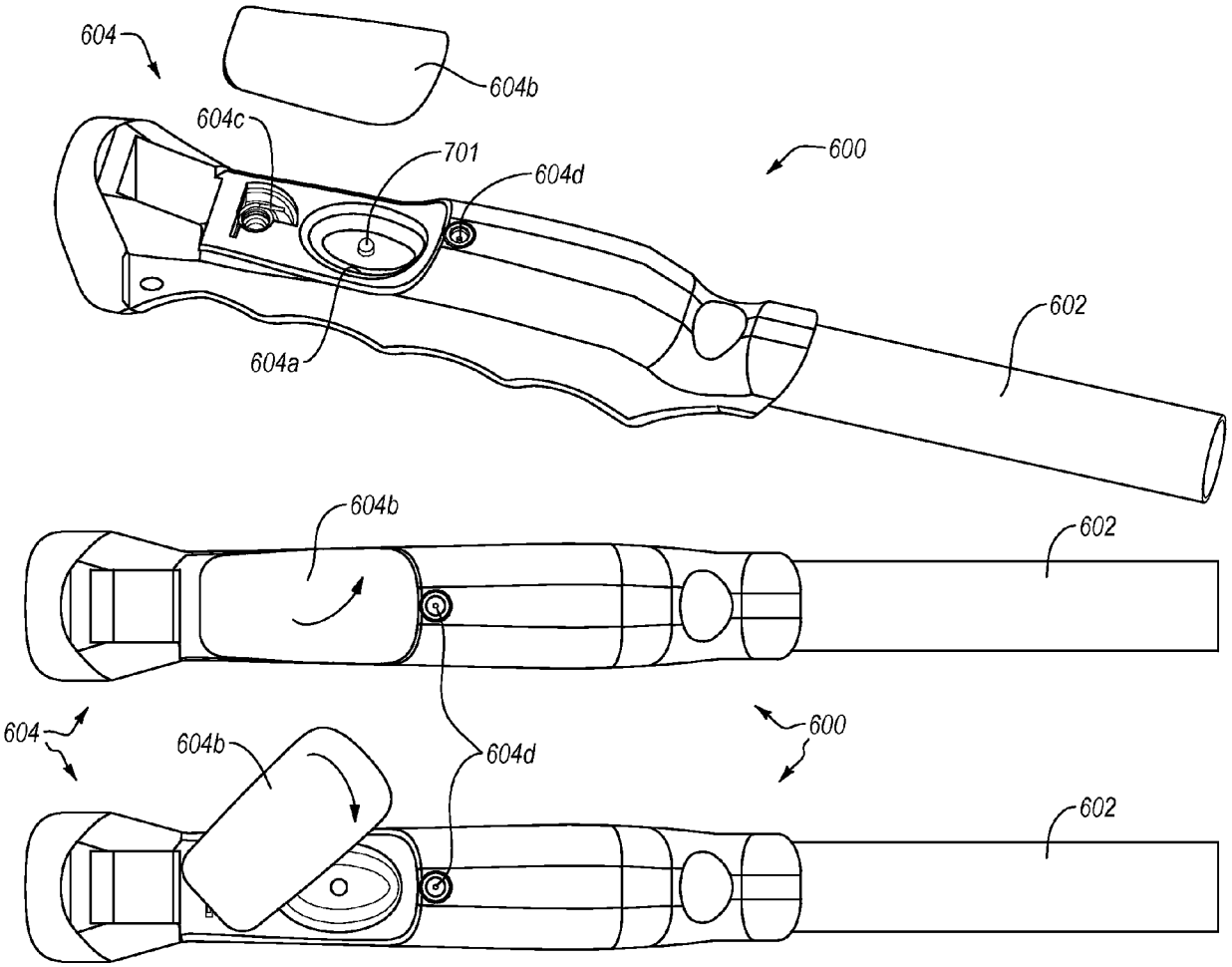
FIG. 18*a* discloses an example of a ski pole configured to house a remote control.
Figure 18B:
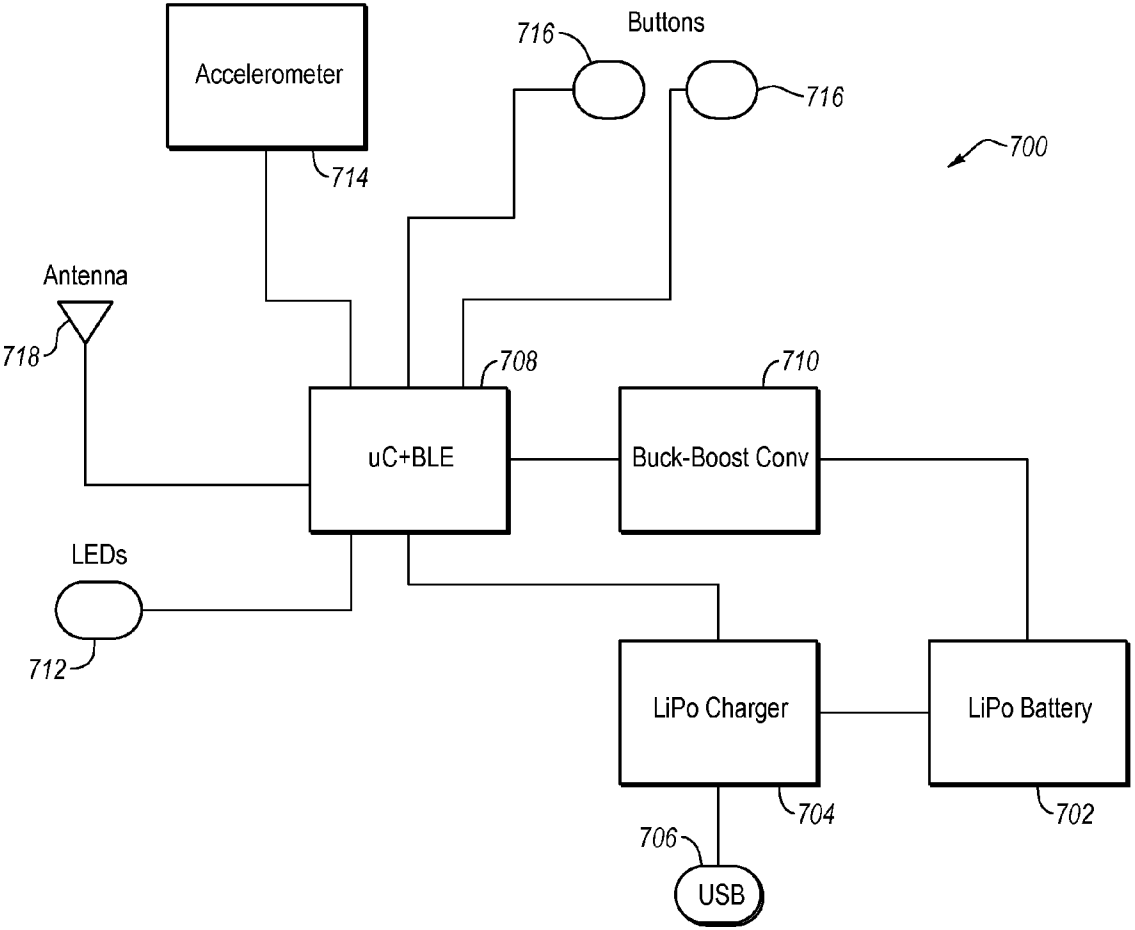
FIG. 18*b* is a block wiring diagram of an example remote control.

Directing attention now to FIGS. 18*a* and 18*b*, details are provided concerning some example devices that a user can employ to remotely activate the ski binding retention and release assembly 400, thereby enabling the toe piece 302 to move forward on the ski 200, and out of engagement with the ski boot 350. The user can, but need not, be the same person who is using the ski boot 350. In general, the circuitry employed to remotely activate the ski binding retention and release assembly 400 can be incorporated into any device desired by a user and, as such, those devices are generally referred to herein as remote control devices. As discussed below, examples of such devices can include, but are not limited to, a ski pole, and a key fob.

In general, the remote control device and ski binding retention and release assembly can communicate wirelessly with each other using any suitable wireless communication protocol or standard. In some embodiments, communication between the remote control device and ski binding retention and release assembly 400 can use Bluetooth® technology and specifications, such as the Bluetooth Low Energy (BLE) standard for example. In at least some embodiments, the ski binding retention and release assembly and the remote control operate in a client-server/peripheral (respectively) relationship. Embodiments of the remote control can be operated on the initiative of the user such that the user can activate the ski binding retention and release assembly to release a ski boot engaged with the ski binding at any time that the user desires.

In at least some embodiments, activation of the wireless communication between the remote control device and ski binding retention and release assembly can be implemented by way of an application ("App"), such as a smartphone App for example. Thus, when a device including the App, such as a smartphone or other device, pairs with the ski binding retention and release assembly, the user can use the App to control the operation of the ski binding retention and release assembly. Correspondingly, the smartphone and/or processors and devices can be configured to communicate using wireless communication protocols, such as the IEEE 802.11X protocols, or the Bluetooth protocol.

As well, embodiments of the remote control are operable to cause further operations in addition to activation of the ski binding retention and release assembly. For example, some embodiments of the remote control can be used to activate a location function that can help a user find a lost ski. This circumstance can arise, for example, when a skier is in deep snow and/or forested terrain. Thus, in some embodiments, provision is made for visible and/or audible signals to be emitted by the ski binding retention and release assembly so as to enable the user to more quickly find the lost ski. As in the case of the activation of the ski binding retention and release assembly, the location function can be activated by way of the remote control on the initiative of the user.

Turning now to FIG. 18*a*, details are provided concerning aspects of example remote controls, one particular example of which is located on a ski pole denoted generally at 600. In terms of its overall configuration, the ski pole 600 can be of conventional construction and, as such, may include a shaft 602 to which a handle 604 is attached. In this particular example however, the handle 604 defines a recess 604*a* within which some or all components of a remote control 700 (see FIG. 18*b*) are disposed, such as an activation button 701. The handle 604 can additionally include a trap door 604*b* or other mechanism that can be selectively moved by the user. The trap door 604*b* can be a sliding or swinging door for example, and maybe spring-loaded by a biasing element 604*c*, such as a spring for example, so as to be biased to a closed position. This location for the remote control 700 is well suited to enable the user ready access to the remote control 700 functions when needed, but is otherwise unobtrusive and does not interfere with the operation of the ski pole 600. The handle 604 may also include a charging port 604*d* that enables the remote control circuitry (not shown) to be connected to a charging source. The trap door 604*b* and/or the body of the handle 604 may include a gasket or other sealing element to help prevent the ingress of snow, ice, water, and dirt into the recess 604*a* when the trap door 604*b* is closed.

In operation, the user can move, such as by rotating, the trap door 604*b* against the bias imposed by the biasing element 604*c* to the position shown in FIG. 18*a* so that the user can access the remote control 700. When the remote control 700 is not in use, the trap door 604*b* can be moved by the user, or automatically by operation of the biasing element 604*c* to a position where the remote control 700 is inaccessible. Among other things then, the trap door 604*b* can help to avoid inadvertent activation of any of the functions of the remote control 700. In at least some embodiments, the trap door 604*b*, recess 604*a*, and/or the body of the handle 604, include a seal, such as a gasket or O-ring for example, that helps to keep snow, water and ice from entering the recess 604*a*. In at least some embodiments, the remote control 700 includes sealed buttons (see FIG. 18*b*), such as rubber buttons, that allow the user to operate the remote control 700 notwithstanding the presence of snow, water and/or ice in the recess 604*a*.

With reference finally to FIG. 18*b*, details are provided concerning the circuitry and operation of an example remote control 700. The remote control 700 includes a power source 702 which can be a replaceable battery, such as a CR2032 battery for example, in some embodiments, such as when the remote control 700 is included in a key fob or similar device. In other embodiments, such as when the remote control 700 is included in the ski pole 600, power can be supplied from a single rechargeable Li-polymer battery. When this battery 702 is fully charged, it may provide 4.2 Vdc.

In embodiments that employ a rechargeable battery, a controller 704 may be provided that can be accessed by a charging port 706, which can be a USB connection, for example. The controller 704 can be an LiPo controller in the form of a stand-alone system load sharing and Li-Ion/Li-Polymer battery charge management controller. This control block employs a constant current/constant voltage (CC/CV) charge algorithm with selectable charge termination point. As well, the LiPo controller provides LiPo battery status to a micro-controller 708. The micro-controller (uC+BLE) 708 can include a single micro-controller and Blue Tooth Low Energy and has a System On Chip (SOC) configuration. Finally, the LiPo controller 704 is supplied charge current or power from the charging port 706.

The remote control 700 can additionally include a buck-boost converter 710 that produces a DC output of 3.3V. The output voltage magnitude is either greater than or less than the input voltage magnitude which is supplied from the power source 702. This supplies a regulated 3.3 Vdc to the microcontroller 708 and other support circuitry. The buck-boost converter 710 can be omitted in embodiments that do not use a rechargeable battery as a power source.

In the example of FIG. 18*b*, the remote control 700 also includes one or more light sources 712. In some embodiments, the light source(s) 712 take the form of light emitting diodes (LED), and can emit light of any color. The light sources 712 may be used to provide visual indication to a user concerning, for example, battery low condition, and low radiated signal strength (RSSI).

In some embodiments of the remote control 700, such as where the remote control 700 is included in a fob for example, an accelerometer 714 is provided that interfaces with the microcontroller 708 via a two wire interface (TWI). The accelerometer 714 enables a user to initiate various functions simply by tapping the fob, or other device, a certain number of times. For example, tapping the buttons 716 of a fob a programmed number of times produces an input to the accelerometer 714 which is then used to initiate either the ski-binding locate function or the ski-binding release function. In this particular example, a hand held fob may have two buttons 716, namely, one button 716 that activates the locate function, and another button 716 that activates the binding release function.

In contrast, the remote control 700 used in a ski pole may have only a single button 716, which can be used to activate the binding release function. However, in yet other embodiments, the remote control 700 used in a ski pole may have two buttons 716, namely, one button 716 that activates the locate function, and another button 716 that activates the binding release function.

Finally, and as suggested earlier, the remote control 700, regardless of whether it is employed in a hand-held device such as a fob, or in a ski pole 600, may include one or more antennas 718. In general, the antennas 718 enable wireless communication between the remote control 700 and a corresponding ski binding retention and release assembly.

G. Example Computing Devices and Associated Media

The embodiments disclosed herein may include the use of a special purpose or general-purpose computer including various computer hardware or software modules, as discussed in greater detail below. A computer may include a processor and computer storage media carrying instructions that, when executed by the processor and/or caused to be executed by the processor, perform any one or more of the methods disclosed herein. In some embodiments, such a computer can take the form of a smartphone or other mobile communication device.

As indicated above, embodiments within the scope of the present invention also include computer storage media, which are physical media for carrying or having computer-executable instructions or data structures stored thereon. Such computer storage media can be any available physical media that can be accessed by a general purpose or special purpose computer.

By way of example, and not limitation, such computer storage media can comprise hardware such as solid state disk (SSD), RAM, ROM, EEPROM, CD-ROM, flash memory, phase-change memory ("PCM"), or other optical disk storage, magnetic disk storage or other magnetic storage devices, or any other hardware storage devices which can be used to store program code in the form of computer-executable instructions or data structures, which can be accessed and executed by a general-purpose or special-purpose computer system to implement the disclosed functionality of the invention. Combinations of the above should also be included within the scope of computer storage media. Such media are also examples of non-transitory storage media, and non-transitory storage media also embraces cloud-based storage systems and structures, although the scope of the invention is not limited to these examples of non-transitory storage media.

Computer-executable instructions comprise, for example, instructions and data which cause a general purpose computer, special purpose computer, or special purpose processing device to perform a certain function or group of functions. Although the subject matter has been described in language specific to structural features and/or methodological acts, it is to be understood that the subject matter defined in the appended claims is not necessarily limited to the specific features or acts described above. Rather, the specific features and acts disclosed herein are disclosed as example forms of implementing the claims.

As used herein, the term 'module' or 'component' can refer to software objects or routines that execute on the computing system. The different components, modules, engines, and services described herein may be implemented as objects or processes that execute on the computing system, for example, as separate threads. While the system and methods described herein can be implemented in software, implementations in hardware or a combination of software and hardware are also possible and contemplated. In the present disclosure, a 'computing entity' may be any computing system as previously defined herein, or any module or combination of modules running on a computing system.

In at least some instances, a hardware processor is provided that is operable to carry out executable instructions for performing a method or process, such as the methods and processes disclosed herein. The hardware processor may or may not comprise an element of other hardware, such as the computing devices and systems disclosed herein.

In terms of computing environments, embodiments of the invention can be performed in client-server environments, whether network or local environments, or in any other suitable environment. Suitable operating environments for at least some embodiments of the invention include cloud computing environments where one or more of a client, server, or target virtual machine may reside and operate in a cloud environment.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A ski binding control and release assembly, comprising:

a housing;

a motor disposed in the housing;

an actuator element disposed in the housing and connected to the motor;

an arm partly disposed in the housing, the arm being operably engaged with the actuator element, and the arm being selectively engageable with a toe piece;

a cover configured to enclose a substantial portion of the housing, and the cover defining an opening through which a portion of the arm protrudes;

a sealing element disposed between the cover and the housing;

a binding plate configured to be disposed on top of the cover, and the binding plate, cover and housing forming a stack that is mountable to a ski, wherein the binding plate is configured to slidingly engage a toe piece of a ski binding so that the toe piece is movable lengthwise relative to the binding plate when the toe piece and the binding plate are engaged with each other; and a control system that is remotely operable to move the arm, and the control system is configured for wireless communication with a remote control device.

2. The ski binding control and release assembly as recited in claim 1, wherein the control system resides in the housing.

3. The ski binding control and release assembly as recited in claim 1, wherein the binding plate includes a stop that limits a range of motion of the toe piece relative to the binding plate or the housing.

4. The ski binding control and release assembly as recited in claim 1, wherein the arm includes a plurality of teeth that are selectively engageable with corresponding teeth of the toe piece when the toe piece is slidingly engaged with the binding plate or housing.

5. The ski binding control and release assembly as recited in claim 1, wherein when the arm is disengaged from the toe piece, the toe piece is free to move along the binding plate, and when the arm is engaged with the toe piece, the toe piece is prevented from moving along the binding plate.

6. The ski binding control and release assembly as recited in claim 1, wherein when the arm is disengaged from the toe piece, the toe piece is free to move forward along the binding plate, and when the arm is engaged with the toe piece, the toe piece is prevented from moving forward along the binding plate and the toe piece is also prevented from moving backward along the binding plate.

7. The ski binding control and release assembly as recited in claim 1, wherein the motor and actuator element are configured and arranged relative to the arm such that the motor is operable to disengage the arm from the toe piece when the toe piece is engaged with the binding plate.

8. The ski binding control and release assembly as recited in claim 1, wherein a biasing element disposed in the housing biases the arm into engagement with the toe piece when the toe piece is at a rearmost position relative to the binding plate.

9. The ski binding control and release assembly as recited in claim 1, wherein the motor comprises an electrically powered gear motor.

10. The ski binding control and release assembly as recited in claim 1, wherein the motor comprises a servomotor with a rotary encoder.

11. The ski binding control and release assembly as recited in claim 1, wherein the control system is configured for radio frequency (RF) communication with the remote control device.

12. The ski binding control and release assembly as recited in claim 1, further comprising a light source and/or a sound source, each of which is configured to be connected to an electrical power source and is operable to provide user-perceptible feedback concerning one or more aspects of one or more components of the ski binding control and release assembly.

13. A ski to which the ski binding control and release assembly as recited in claim 1 is attached.

14. A ski binding, comprising:

a heel piece mountable to a ski;

a toe piece mountable to a ski and configured to cooperate with the heel piece to releasably retain a ski boot; and the ski binding control and release assembly as recited in claim 1.

15. A ski binding control and release assembly, comprising:

a housing;

a motor disposed in the housing;

an actuator element disposed in the housing and connected to the motor;

an arm partly disposed in the housing, the arm being operably engaged with the actuator element, and the arm being selectively engageable with a toe piece of a ski binding;

a cover configured to enclose a substantial portion of the housing, and the cover defining an opening through which a portion of the arm protrudes;

a sealing element disposed between the cover and the housing;

a binding plate configured to be disposed on top of the cover, and the binding plate, cover and housing forming a stack that is mountable to a ski, wherein the binding plate or housing includes a biasing element that biases the toe piece in a forward direction such that the toe piece is moved forward by the biasing element when the arm is disengaged from the toe piece; and a control system that is remotely operable to move the arm, and the control system is configured for wireless communication with a remote control device.

16. The ski binding control and release assembly as recited in claim 15, wherein the binding plate is configured to slidingly engage the toe piece of a ski binding so that the toe piece is movable lengthwise relative to the binding plate when the toe piece and the binding plate are engaged with each other.

17. The ski binding control and release assembly as recited in claim 15, wherein when the arm is disengaged from the toe piece, the toe piece is free to move along the binding plate, and when the arm is engaged with the toe piece, the toe piece is prevented from moving along the binding plate.

18. A ski binding, comprising:

a heel piece mountable to a ski;

a toe piece mountable to a ski and configured to cooperate with the heel piece to releasably retain a ski boot; and a ski binding control and release assembly, comprising:

a housing;

a motor disposed in the housing;

an actuator element disposed in the housing and connected to the motor;

an arm partly disposed in the housing, the arm being operably engaged with the actuator element, and the arm being selectively engageable with the toe piece;

a cover configured to enclose a substantial portion of the housing, and the cover defining an opening through which a portion of the arm protrudes;

a binding plate configured to be disposed on top of the cover, and the binding plate, cover and housing forming a stack that is mountable to a ski, wherein when the arm is disengaged from the toe piece, the toe piece is free to move along the binding plate, and when the arm is engaged with the toe piece, the toe piece is prevented from moving along the binding plate; and a control system that is remotely operable to move the arm, and the control system is configured for wireless communication with a remote control device.

19. The ski binding as recited in claim 18, wherein the toe piece is configured and arranged to move relative to the heel piece such that a distance between the toe piece and the heel piece changes when the toe piece moves relative to the heel piece.

20. The ski binding as recited in claim 18, wherein the ski binding is configured to enable a ski boot of a user to enter, and releasably engage, the ski binding heel-first.

21. The ski binding as recited in claim 18, wherein the motor and actuator element are configured and arranged relative to the arm such that the motor is operable to disengage the arm from the toe piece when the toe piece is engaged with the binding plate.

22. The ski binding as recited in claim 18, wherein the binding plate includes a biasing element that biases the toe piece in a forward direction such that the toe piece is moved forward by the biasing element when the arm is disengaged from the toe piece.

23. A ski to which the ski binding as recited in claim 18 is mounted.

24. The ski binding as recited in claim 18, wherein the motor comprises an electrically powered gear motor.

25. The ski binding as recited in claim 18, wherein the control system is configured for radio frequency (RF) communication with the remote control device.

26. A remote control ski binding system, comprising:

a ski binding, comprising:

a heel piece mountable to a ski;

a toe piece mountable to a ski and configured to cooperate with the heel piece to releasably retain a ski boot; and ski binding control and release assembly, comprising:

a housing;

a motor disposed in the housing;

an actuator element disposed in the housing and connected to the motor;

an arm partly disposed in the housing, the arm being operably engaged with the actuator element, and the arm being selectively engageable with the toe piece, wherein the actuator element and motor are configured and arranged relative to the arm such that the motor is operable to disengage the arm from the toe piece when the toe piece is engaged with the binding plate;

a cover configured to enclose a substantial portion of the housing, and the cover defining an opening through which a portion of the arm protrudes;

a binding plate configured to be disposed on top of the cover, and the binding plate, cover and housing forming a stack that is mountable to a ski;

a control system that is remotely operable to move the arm; and a remote control configured for wireless communication with the control system such that movement of the toe piece can be effected by way of the remote control.

27. The remote control ski binding system as recited in claim 26, wherein the remote control is housed in a handheld device, or in a ski pole.

28. The remote control ski binding system as recited in claim 26, wherein the binding plate includes a biasing element that biases the toe piece in a forward direction such that the toe piece is moved forward by the biasing element when the arm is disengaged from the toe piece.

29. The remote control ski binding system as recited in claim 26, wherein a biasing element disposed in the housing biases the arm into engagement with the toe piece when the toe piece is at a rearmost position relative to the binding plate.

30. A ski to which the following are attached:
the ski binding as recited in claim 26; and
the ski binding control and release assembly as recited in claim 26.

* * * * *